US008564507B2

(12) United States Patent
Jang et al.

(10) Patent No.: US 8,564,507 B2
(45) Date of Patent: Oct. 22, 2013

(54) DISPLAY APPARATUS

(75) Inventors: Jin-Won Jang, Asan-si (KR); Youngsup Kwon, Gwangmyeong-si (KR); Won Sik Oh, Asan-si (KR); Min-Soo Choi, Asan-si (KR)

(73) Assignee: Samsung Display Co., Ltd. (KR)

( * ) Notice: Subject to any disclaimer, the term of this patent is extended or adjusted under 35 U.S.C. 154(b) by 220 days.

(21) Appl. No.: 12/973,209

(22) Filed: Dec. 20, 2010

(65) Prior Publication Data

US 2011/0279485 A1 Nov. 17, 2011

(30) Foreign Application Priority Data

May 12, 2010 (KR) ..... 10-2010-0044554

(51) Int. Cl.
*G09G 3/30* (2006.01)

(52) U.S. Cl.
USPC ..... 345/76; 345/102; 345/204; 345/690

(58) Field of Classification Search
USPC ..... 345/76–82, 45, 55, 58, 102, 204–215, 345/690; 315/169.3
See application file for complete search history.

(56) References Cited

U.S. PATENT DOCUMENTS

| | | | | |
|---|---|---|---|---|
| 7,177,064 | B2 * | 2/2007 | Park | 359/270 |
| 2006/0050032 | A1 * | 3/2006 | Gunner et al. | 345/82 |
| 2006/0170632 | A1 | 8/2006 | Togashi et al. | |
| 2007/0285379 | A1 * | 12/2007 | Jung et al. | 345/102 |
| 2008/0284946 | A1 | 11/2008 | Abe et al. | |
| 2009/0059130 | A1 * | 3/2009 | Kim et al. | 349/65 |
| 2009/0184906 | A1 | 7/2009 | Park et al. | |
| 2009/0295309 | A1 | 12/2009 | Kang et al. | |
| 2010/0052564 | A1 * | 3/2010 | Park et al. | 315/291 |
| 2010/0225674 | A1 * | 9/2010 | Choe et al. | 345/690 |

FOREIGN PATENT DOCUMENTS

| | | |
|---|---|---|
| JP | 2002341312 | 11/2002 |
| JP | 2008-287892 | 11/2008 |
| KR | 1020060112432 | 11/2006 |
| KR | 1020080023812 | 3/2008 |
| WO | 02079862 | 10/2002 |

OTHER PUBLICATIONS

Shiga et al; "Power savings and enhancements of gray-scale capability of LCD TV's with an adaptive dimming technique" Journal of the SID 16/2, 2008, pp. 311-316.

* cited by examiner

*Primary Examiner* — Hong Zhou
(74) *Attorney, Agent, or Firm* — Cantor Colburn LLP

(57) ABSTRACT

A display apparatus includes a backlight unit which emits a light, and a display panel which receives the light to display an image. The backlight unit includes a driving circuit which outputs a driving voltage and a reference voltage; and p light source blocks connected to the driving circuit, p being a natural number greater than or equal to 2, where each light source block of the p light source blocks receives the driving voltage through a first terminal thereof and the reference voltage through a second terminal thereof to generate the light, and the p light source blocks are divided into a plurality of groups, each group including at least two light source blocks. The driving circuit includes a first switching section which applies the driving voltage to first terminals of the p light source blocks, and a second switching section which applies the reference voltage to the second terminal of at least one of the p light source blocks.

16 Claims, 19 Drawing Sheets

| | SW1 (204) | SW2 (246) | SW3 (254) |
|---|---|---|---|
| SW4(250) | LB1 (0) | LB4 (246) | LB7 (250) |
| SW5(254) | LB2 (0) | LB5 (246) | LB8 (254) |
| SW6(254) | LB3 (0) | LB6 (246) | LB9 (254) |

DISPLAY APPARATUS

This application claims priority to Korean Patent Application No. 2010-44554, filed on May 12, 2010, and all the benefits accruing therefrom under 35 U.S.C. §119, the content of which in its entirety is herein incorporated by reference.

BACKGROUND OF THE INVENTION

1. Field of the Invention

The general inventive concept relates to a display apparatus with substantially reduced number of components and connection lines.

2. Description of the Related Art

A liquid crystal display ("LCD") includes a liquid crystal display panel to display images and a backlight unit provided below the liquid crystal display panel to supply light to the liquid crystal display panel. Generally, a cold cathode fluorescent lamp ("CCFL") is used for the backlight unit.

However, recently, to reduce the amount of power consumption while improving color reproducibility, the backlight unit may employ a light emitting diode ("LED") as its light source instead of the CCFL. An LED backlight unit which employs the LED as its light source includes a plurality of light emitting blocks, each including a plurality of LEDs connected to each other in series.

In addition, the LED backlight unit may be classified into a various types of backlight unit, such as an edge illumination-type backlight unit and a direct illumination-type backlight unit, for example, according to the position of LEDs. Recently, as a light and slim LCD has been developed, the edge illumination-type backlight unit has been widely used.

BRIEF SUMMARY OF THE INVENTION

The inventive concept of the present invention relates to a display apparatus configured to reduce the number of components and connection lines.

According to an exemplary embodiment, the display apparatus includes a backlight unit which emits a light, and a display panel which receives the light to display an image. The backlight unit includes a driving circuit which outputs a driving voltage and a reference voltage; and p light source blocks connected to the driving circuit, p being a natural number greater than or equal to 2, where each light source block of the p light source blocks receives the driving voltage through a first terminal thereof and the reference voltage through a second terminal thereof to generate the light, and the p light source blocks are divided into a plurality of groups, each group including at least two light source blocks. The driving circuit includes a first switching section which applies the driving voltage to first terminals of the p light source blocks, and a second switching section which applies the reference voltage to the second terminal of at least one of the p light source blocks.

In one exemplary embodiment, the first switching section may include n switching devices commonly connected, n being a natural number greater than or equal to 1, and each of the n switching devices are connected to first terminals of the at least two light source blocks in a group corresponding thereto, and the second switch section may include m switching devices commonly connected, m being a natural number greater than or equal to 1, and each of the m switching devices are connected to at least one of second terminals of the at least two light source blocks of each group.

In one exemplary embodiment, each light source block of the p light source blocks may emit light when a switching device of the m switching devices connected to the first terminal thereof and a switching device of the n switching devices connected to the second terminal thereof are turned on.

In one exemplary embodiment, a sum of n and m is less than p.

In one exemplary embodiment, n and m are divisors of p and make a smallest sum among all possible sums of two divisors of p, where a product of the two divisors is equal to p.

In one exemplary embodiment, the driving circuit may supply n first control signals to the n switching devices, and supply m second control signals to the m switching devices.

In one exemplary embodiment, a high level duration of a first control signal of the n first control signals and a high level duration of a second control signal of the m second control signal may overlap with each other in time, and a turn-on duration of a light source block which receives the first control signal and the second control signal may be determined by an overlapping time period of the high level duration of the first control signal and the high level duration of the second control signal.

In one exemplary embodiment, the n first control signals may be simultaneously applied to the n switching devices, and the m second control signals are sequentially applied to the m switching devices in one dimming frame unit.

In one exemplary embodiment, the display apparatus may further include a printed circuit board with the light source blocks disposed thereon. The printed circuit board may include q connection lines through which the driving voltage is supplied to the first terminal of each light source block, q being a natural number greater than or equal to 1, and r connection lines through which the reference voltage is supplied to the second terminal of at least one of the light source blocks, r being a natural number greater than or equal to 1, where a sum of q and r is less than p.

In one exemplary embodiment, q and the r are two divisors of p and define a smallest sum among all possible sums of two divisors of p, where a product of the two divisors is equal to p.

In one exemplary embodiment, the printed circuit board may include a double-sided printed circuit board, and each connection line of the q connection lines and the r connection lines may be disposed on at least one surface of the double-sided printed circuit board.

In one exemplary embodiment, the display apparatus may further include a connector which connects the q connection lines of the printed circuit board to the first switching section and connects the r connection lines of the printed circuit board to the second switching section.

In one exemplary embodiment, the display apparatus may further include a light guide plate which receives the light output from the backlight unit through at least one side surface thereof and outputs the light through an exit surface thereof a plurality of light emitting diodes disposed on a top surface of the printed circuit board, where an incident surface of each of the plurality of light emitting diodes is substantially perpendicular to the top surface of the printed circuit board.

In one exemplary embodiment, the display apparatus may further include a plurality of light emitting diodes disposed on a top surface of the printed circuit board, wherein an incident surface of each of the plurality of light emitting diodes is substantially parallel to a top surface of the printed circuit board.

In one exemplary embodiment, the display panel may be divided into a plurality of dimming regions corresponding to the p light source blocks, and brightness of each of the p light source blocks is adjusted based on a representative brightness value of a respective dimming region of the plurality of dimming regions corresponding to each of the p light source blocks.

In one exemplary embodiment, the display apparatus may further include a timing controller which supplies an image signal to the display panel. The timing controller may includes a timing determiner which calculates and determines a representative brightness value of each dimming region of the plurality of dimming regions based on the image signal, a representative value compensator which calculates a brightness compensation value of each dimming region of the plurality of dimming regions by compensating the representative brightness value, and a pixel corrector which corrects the image signal supplied to each dimming region of the plurality of dimming regions based on the brightness compensation value.

In one exemplary embodiment, the pixel corrector may compare a target dimming level of each light source block and a real dimming level of the light source block, and correct the image signal supplied to each dimming region based on a differential value between the real dimming level and the target dimming level when the real dimming level is different from the target dimming level.

As described above, the number of switching devices to control the turn-on durations of the light source blocks may be reduced to be less than the number of light source blocks, and the number of the whole components of the backlight unit is thereby substantially reduced.

In addition, as the number of the switching devices is reduced, the number of connection lines provided in the printed circuit board, on which the light source blocks are disposed, may be reduced, and the whole width of the printed circuit board is thereby substantially reduced.

BRIEF DESCRIPTION OF THE DRAWINGS

The above and other aspects and features of this disclosure will become more apparent by describing in further detail exemplary embodiments thereof with reference to the accompanying drawings, in which.

DETAILED DESCRIPTION OF THE INVENTION

Figure 1:
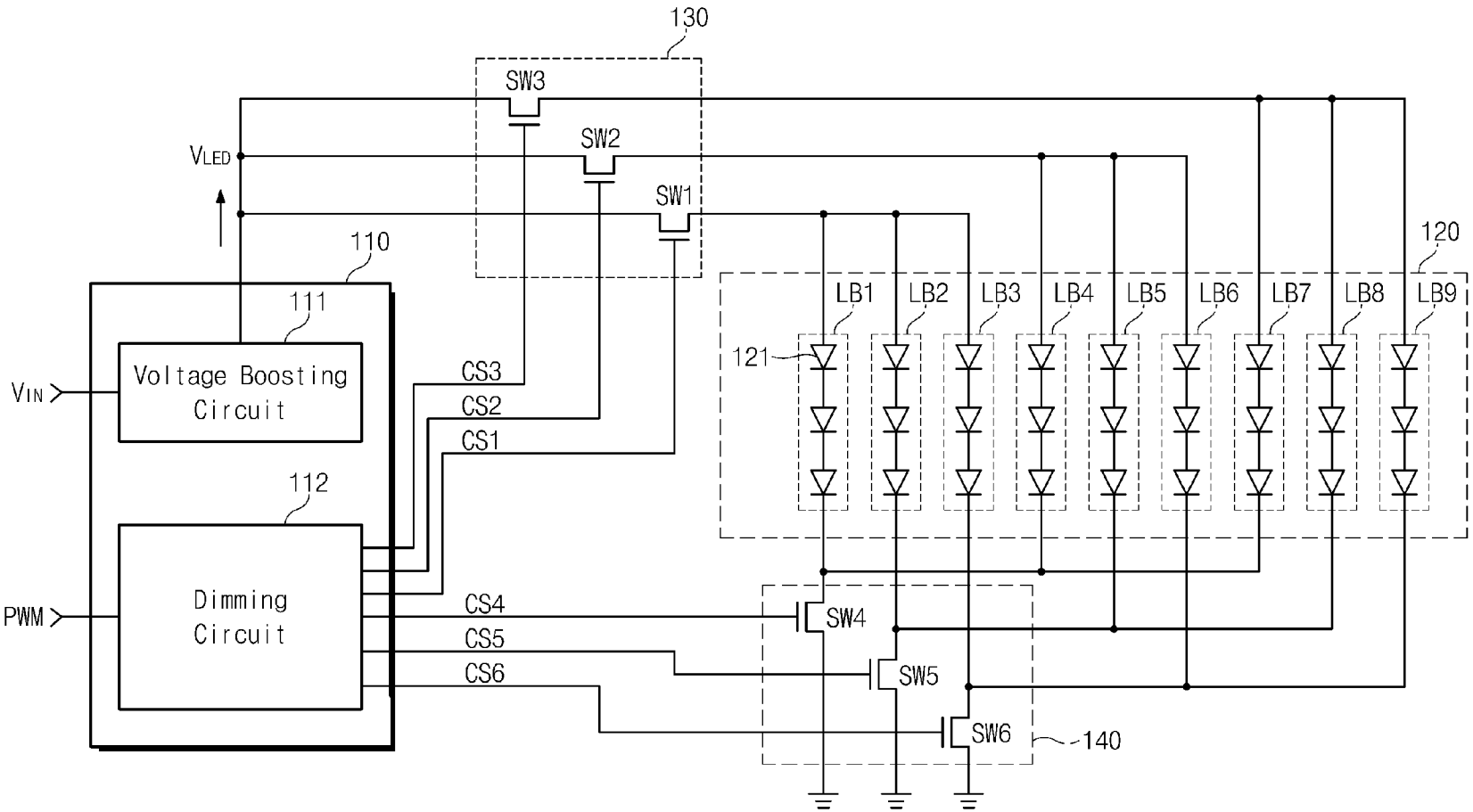
FIG. 1 is a schematic circuit diagram of an exemplary embodiment of a backlight unit according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope thereof unless otherwise claimed. No language in the specification should be construed as indicating any non-claimed element as essential to the practice of the embodiments as used herein.

Hereinafter, exemplary embodiments according to the present invention will be described in detail with reference to accompanying drawings.

FIG. 1 is a schematic circuit diagram of an exemplary embodiment of a backlight unit 100 according to the present invention.

Referring to FIG. 1, the backlight unit 100 includes a driving circuit 110, a light source unit 120, a first switch section 130 and a second switch section 140.

The driving circuit 110 includes a voltage boosting circuit 111 and a dimming circuit 112. The voltage boosting circuit 111 receives an input voltage $V_{IN}$ from an external device and boosts the input voltage $V_{IN}$ to a driving voltage $V_{LED}$ to drive the light source unit 120.

The dimming circuit 112 receives a dimming signal PWM from an external device and outputs control signals (e.g., first to sixth control signals CS1 to CS6) according to the diming signal PWM to control the overall brightness of the light source unit 120 or the brightness of each light source block of the light source unit 120. The first to third control signals CS1 to CS3 among the first to sixth control signals CS1 to CS6 are transmitted to the first switching section 130, and the fourth to sixth control signals CS4 to CS6 are transmitted to the second switching section 140. The time periods of high level durations of the first to sixth control signals CS1 to CS6 may be adjusted based on the dimming signal PWN. The first to sixth control signals CS1 to CS6 will be described in greater detail later with reference to FIG. 3.

The light source unit 120 includes a plurality of light source blocks (e.g., first to ninth light source blocks LB1 to LB9). Each of the first to ninth light source blocks LB1 to LB9 includes a plurality of light emitting diodes ("LED"s) 121. In an exemplary embodiment, the each of the first to ninth light source blocks LB1 to LB9 includes three LEDs 121 connected to each other in series. However, a number of the LEDs 121 included in the each of the first to ninth light source blocks LB1 to LB9 may vary, not being limited to three. In an alternative exemplary embodiment, the number of light source blocks constituting the light source unit 120 may be nine, for example.

In an exemplary embodiment, the first switching section 130 includes switching devices, e.g., first to third switching devices SW1, SW2 and SW3.

The first switching device SW1 includes a first electrode connected to an output terminal of the voltage boosting circuit 111 and which receives the driving voltage $V_{LED}$, a second electrode which receives the first control signal CS1 from the dimming circuit 112, and a third electrode connected to first terminals (e.g., anode of the first LED 121 of each light source block) of the first to third light source blocks LB1, LB2 and LB3. The second switching device SW2 includes a first electrode connected to the output terminal of the voltage boosting circuit 111 and which receives the driving voltage $V_{LED}$, a second electrode to receive the second control signal CS2 from the dimming circuit 112, and a third electrode commonly connected to first terminals (e.g., anode of the first LED 121 of each light source block) of the fourth to sixth light source blocks LB4, LB5 and LB6. The third switching device SW3 includes a first electrode connected to the output terminal of the voltage boosting circuit 111 and which receives the driving voltage $V_{LED}$, a second electrode which receives the third control signal CS3 from the dimming circuit 112, and a third electrode connected to first terminals (e.g., anode of the first LED 121 of each light source block) of the seventh to ninth light source blocks LB7, LB8 and LB9.

The second switching section 140 includes fourth to sixth switching devices SW4, SW5 and SW6. The fourth switching device SW4 includes a first electrode connected to second terminals (e.g., cathode of the last LED 121 of each light source block) of the first, fourth, and seventh light source blocks LB1, LB4 and LB7, a second electrode which receives the fourth control signal CS4 from the dimming circuit 112, and a third electrode which receives a reference voltage. The driving voltage $V_{LED}$ is a positive voltage, and the reference voltage may be a ground voltage or a negative voltage. The fifth switching device SW5 includes a first electrode connected to second terminals (e.g., cathode of the last LED 121 of each light source block) of the second, fifth, and eighth light source blocks LB2, LB5 and LB8, a second electrode which receives the fifth control signal CS5 from the dimming circuit 112, and a third electrode which receives the reference voltage. The sixth switching device SW6 includes a first electrode connected to second terminals (e.g., cathode of the last LED 121 of each light source block) of the third, sixth, and ninth light source blocks LB3, LB6 and LB9, a second electrode which receives the sixth control signal CS6 from the dimming circuit 112, and a third electrode which receives the reference voltage.

Figure 4:
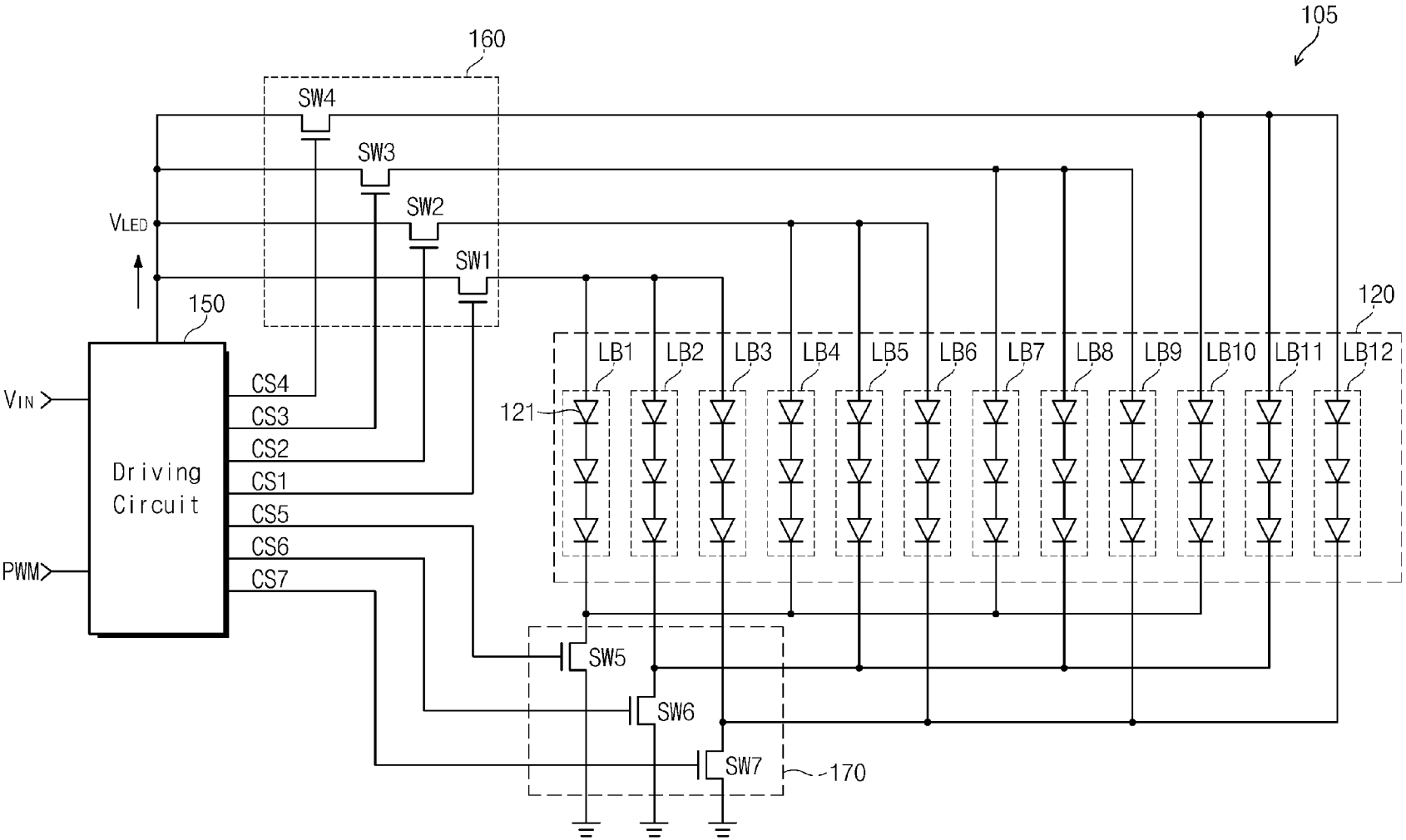
FIG. 4 is a schematic circuit diagram of an alternative exemplary embodiment of a backlight unit according to the present invention.
Figure 5:
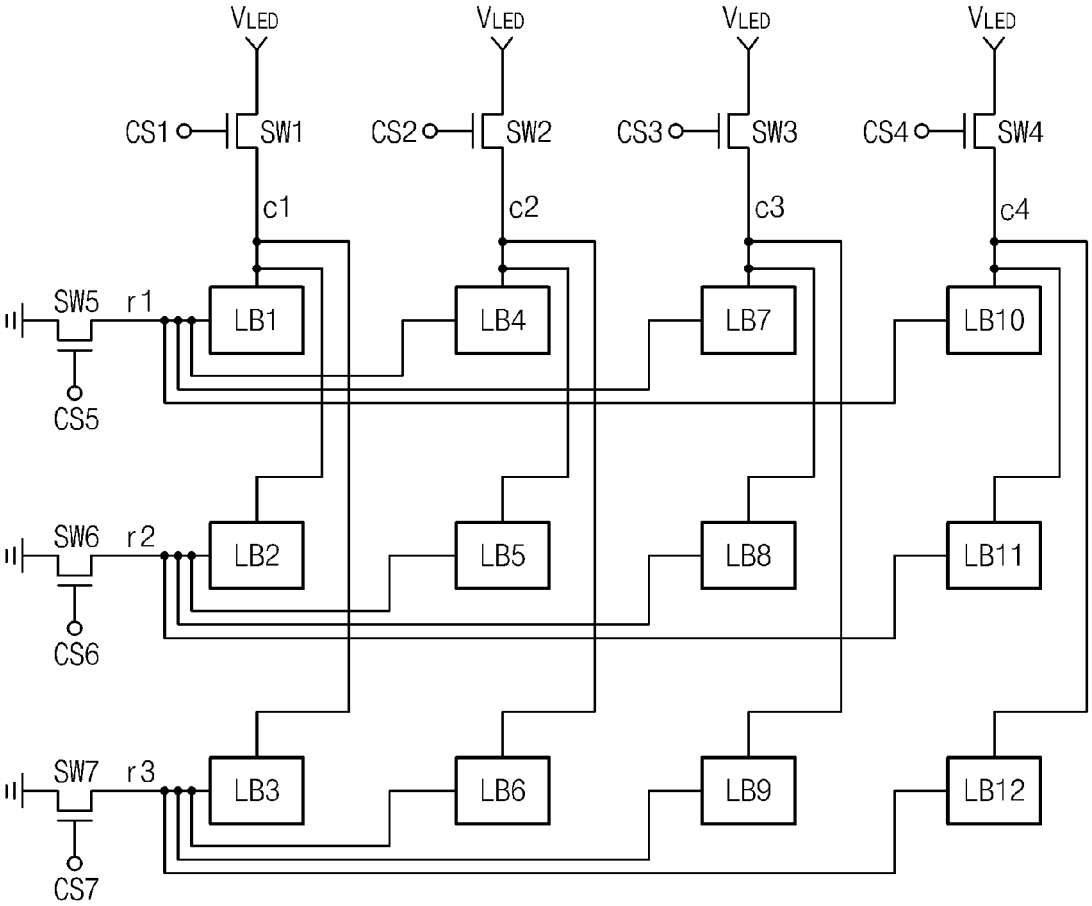
FIG. 5 is a schematic circuit diagram of first to seventh switching devices and first to twelfth light source blocks of FIG. 4, showing connections therebetween.

As shown in FIG. 1, when the light source unit 120 includes nine light source blocks, e.g., the first to ninth light source blocks LB1 to LB9, the first switching section 130 includes three switching devices SW1 to SW3, and the second switching section 140 includes three switching devices SW4 to SW6. In an alternative exemplary embodiment, when the light source unit 120 includes 12 light source blocks, e.g., first to twelfth light source block LB1 to LB12, the first switching section 160 may include four switching devices, e.g., the first to fourth light source block SW1 to SW4, and the second switching section 170 may include three switching devices, e.g., the fifth to seventh light source block SW5 to SW7 (as shown in FIGS. 4 and 5).

Similarly, when the light source unit 120 includes p light source blocks, and the first and second switching sections 130 and 140 include n switching devices and m switching devices, respectively, (m, n and p are natural numbers), the sum of n and m may be less than p. In addition, n and m may be divisors of p, that is, n and m may evenly divide p without leaving a remainder. In an exemplary embodiment, n and m are divisors of p and define the smallest sum among all possible sums of two divisors of p, where a product of the two divisors is equal to p.

As shown in FIG. 1, the backlight unit 100 may include the first to sixth switching devices SW1 to SW6, which is less than the first to ninth light source blocks LB1 to LB9 in number. As a result, the number of whole components of the backlight unit 100 may be substantially reduced.

Figure 2:
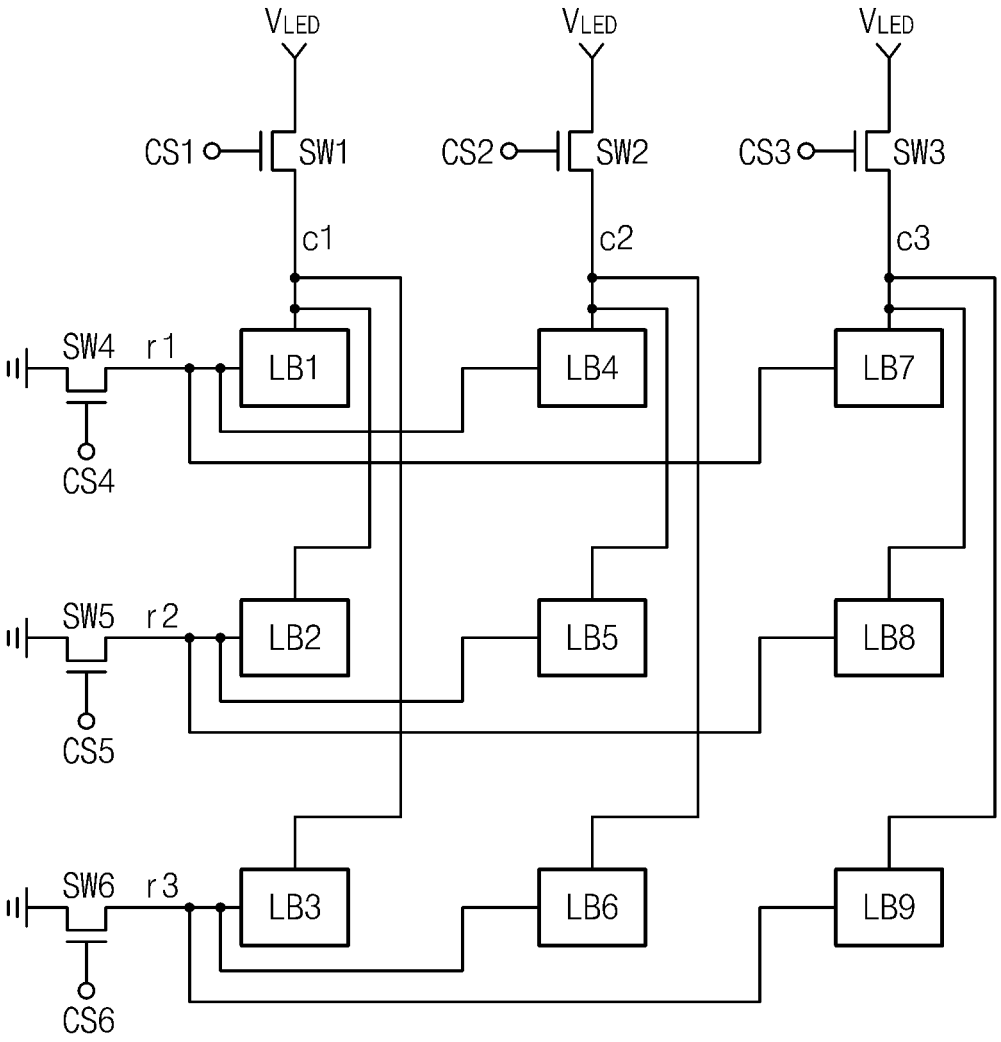
FIG. 2 is a schematic circuit diagram of first to sixth switching devices and first to ninth light source blocks of FIG. 1, showing connections therebetween.
Figure 3:
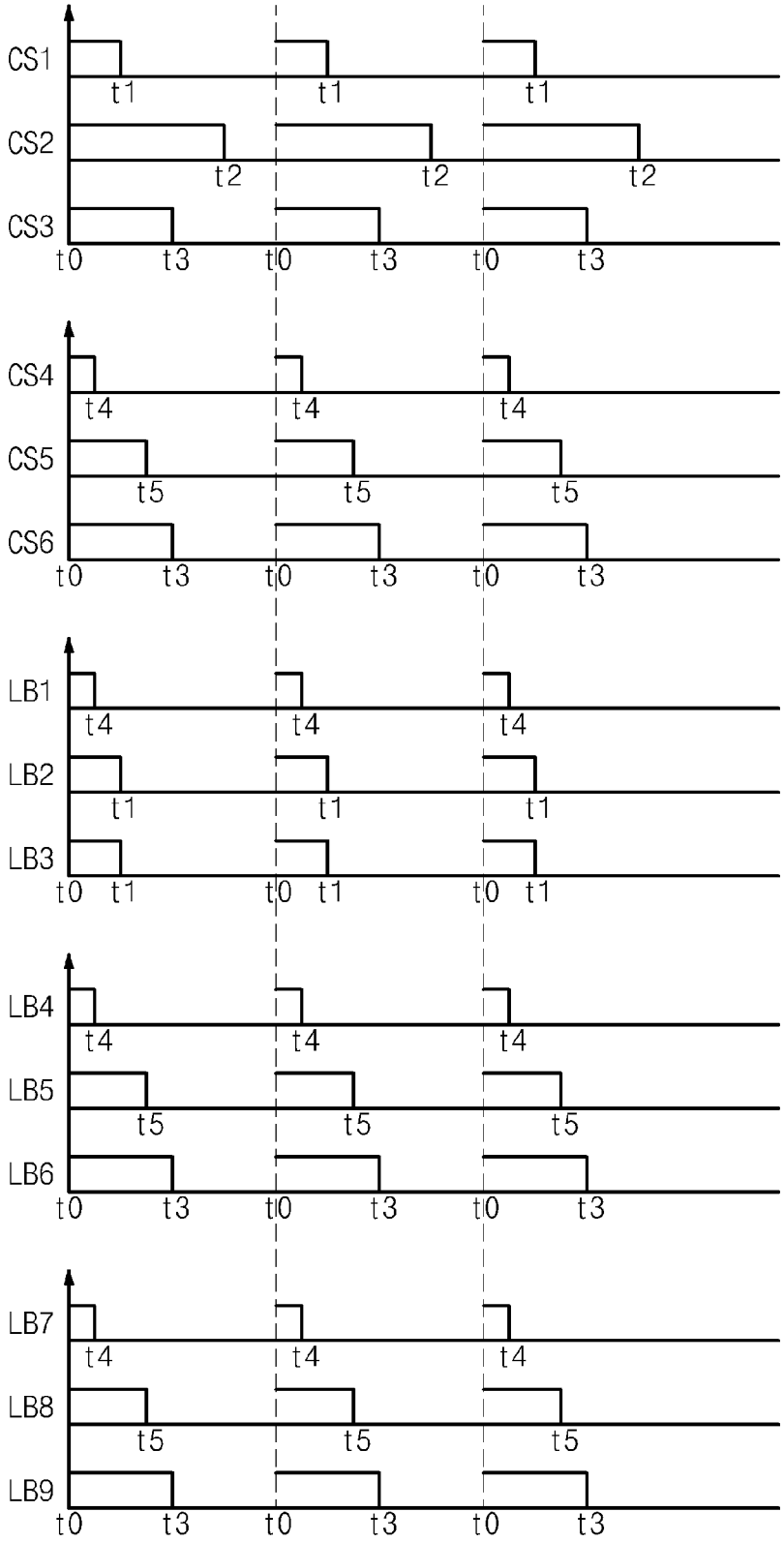
FIG. 3 is a signal timing diagram showing turn-on durations of the first to ninth light source blocks according to the high level durations of first to sixth control signals of FIG. 2.

FIG. 2 is a schematic circuit diagram of the first to sixth switching devices SW1 to SW6 and the first to ninth light source blocks LB1 to LB9 of FIG. 1, showing connections therebetween. FIG. 3 is a signal timing diagram showing turn-on durations of the first to ninth light source blocks LB1 to LB9 according to the high level durations of the first to sixth control signals CS1 to CS6 of FIG. 2.

Referring to FIG. 2, the first to ninth light source blocks LB1 to LB9 may be arranged in the form of a matrix defined by first to third columns c1 to c3 connected to the first to third switching devices SW1 to SW3, respectively, and first to third rows r1 to r3 connected to the fourth to sixth switching devices SW4 to SW6, respectively.

The first switching device SW1 connected to the first column c1 supplies the driving voltage $V_{LED}$ to the first to third light source blocks LB1 to LB3 in response to the first control signal CS1. The second switching device SW2 connected to the second column c2 supplies the driving voltage $V_{LED}$ to the fourth to sixth light source blocks LB4 to LB6 in response to the second control signal CS2. The third switching device SW3 connected to the third column c3 supplies the driving voltage $V_{LED}$ to the seventh to ninth light source blocks LB7 to LB9 in response to the second control signal CS3.

The fourth switching device SW4 connected to the first row r1 supplies the reference voltage to the first, fourth and seventh light source blocks LB1, LB4 and LB7 in response to the fourth control signal CS4. The fifth switching device SW5 connected to the second row r2 supplies the reference voltage to the second, fifth, and eight light source blocks LB2, L54 and LB8 in response to the fifth control signal CS5. The sixth switching device SW6 connected to the third row r3 supplies the reference voltage to the third, sixth and ninth light source blocks LB3, LB6 and LB9 in response to the sixth control signal CS6.

When both of two switching devices connected to each light source block are turned on, each light source block emits light. In an exemplary embodiment, the turn-on duration of each light source block may be determined by the turn-on durations of the two switching devices connected to each light source block. Since the turn-on duration of each switching device is determined by a control signal applied to the switching device, the turn-on durations of the first to ninth light source blocks LB1 to LB9 may be determined by the high level durations of the first to sixth control signals CS1 to CS6. FIG. 3 shows the turn-on durations of the first to ninth light source blocks LB1 to LB9 according to the high level durations of the first to sixth control signals CS1 to CS6.

Referring now to FIG. 3, the high level duration of the first control signal CS1 is set between zero time t0 to first time t1 in each time frame, and the high level duration of the second control signal CS2 is set between the zero time t0 to second time t2 in each time frame. The high level duration of the third control signal CS3 is set between the zero time t0 to third time t3 in each time frame.

The high level duration of the fourth control signal CS4 is set between the zero time t0 to fourth time t4 in each time frame, and the high level duration of the fifth control signal CS5 is set between the zero time t0 to the fifth time t5 in each time frame. The high level duration of the sixth control signal CS6 is set between the zero time t0 to the sixth time t6 in each time frame.

The first light source block LB1 is turned on for a time period during which the high level duration of the first control signal C1 is overlapped with the high level duration of the fourth control signal CS4 in time. In an exemplary embodiment, the first light source block LB1 has a turn-on duration corresponding to the high level duration of the fourth control signal CS4 having a narrower time period between the high level duration of the first control signal CS1 and the high level duration of the fourth control signal CS4. In an exemplary embodiment, the first light source block LB1 is turned on between the zero time t0 to the fourth time t4.

The second light source block LB2 is turned on for a time period during which the high level duration of the first control signal CS1 is overlapped with the high level duration of the fifth control signal CS5 in time. In an exemplary embodiment, the second light source block LB2 is turned on between the zero time t0 and the first time t1.

The third light source block LB3 is turned on for a time period during which the high level duration of the first control signal CS1 is overlapped with the high level duration of the sixth control signal CS6 in time. In an exemplary embodiment, the third light source block LB3 is turned on between the zero time t0 and the first time t1.

The fourth light source block LB4 is turned on for a time period during which the high level duration of the second control signal CS2 is overlapped with the high level duration of the fourth control signal CS4. In an exemplary embodiment, the fourth light source block LB4 is turned on between the zero time t0 and the fourth time t4.

The fifth light source block LB5 is turned on for a time period during which the high level duration of the second control signal CS2 is overlapped with the high level duration of the fifth control signal CS5 in time. In an exemplary embodiment, the fifth light source block LB5 is turned on between the zero time t0 and the fourth time t5.

The sixth light source block LB6 is turned on for a time period during which the high level duration of the second control signal CS2 is overlapped with the high level duration of the sixth control signal CS6 in time. In an exemplary embodiment, the sixth light source block LB6 is turned on between the zero time t0 and the third time t3.

The seventh light source block LB7 is turned on for a time period during which the high level duration of the third control signal CS3 is overlapped with the high level duration of the fourth control signal CS4 in time. In an exemplary embodiment, the seventh light source block LB7 is turned on between the zero time t0 and the fourth time t4.

The eighth light source block LB8 is turned on for a time period during which the high level duration of the third control signal CS3 is overlapped with the high level duration fifth control signals CS3 and CS5 in time. In an exemplary embodiment, the eighth light source block LB8 is turned on between the zero time t0 and the fifth time t5.

The ninth light source block LB9 is turned on for a time period during which the high level duration of the third control signal CS3 is overlapped with the high level duration of the sixth control signals CS3 and CS6 in time. In an exemplary embodiment, the ninth light source block LB9 is turned on between the zero time t0 and the third time t3.

As described above, the turn-on duration of each of the light source blocks LB1 to LB9 may be determined by controlling the time periods of the high level durations of two control signals applied to two switching devices connected to each of the light source blocks LB1 to LB9. Accordingly, an amount of light output from the light source blocks LB1 to LB9 may be thereby controlled.

FIG. 4 is a schematic circuit diagram of an alternative exemplary embodiment of a backlight unit 105 according to the present invention, and FIG. 5 is a schematic circuit diagram of first to seventh switching devices SW1 to SW7 and first to twelfth light source blocks LB1 to LB12 of FIG. 4, showing connections therebetween.

Referring to FIG. 4, the backlight unit 105 includes the light source unit 120, a driving circuit 150, a first switching section 160 and a second switching section 170.

The first driving circuit 150 receives the input voltage $V_{IN}$ from an external device and boosts the input voltage $V_{IN}$ to the driving voltage $V_{LED}$ to drive the light source unit 120. The driving circuit 150 receives the dimming signal PWM from an external device and outputs control signals (e.g., first to seventh control signals CS1 to CS7) based on the diming signal PWM to control the whole brightness of the light source unit 120 or the brightness of each block of the light source unit 120. The first to fourth control signals CS1 to CS4 among the first to seventh control signals CS1 to CS7 are applied to the first switching section 160, and the fifth to seventh control signals CS5 to CS7 are applied to the second switching section 170. The driving circuit 150 can adjust the time periods of high level durations of the first to seventh control signals CS1 to CS7 based on the dimming signal PWN.

The light source unit 120 includes a plurality of light source blocks (e.g., first to twelfth light source blocks LB1 to LB12). Each of the first to twelfth light source blocks LB1 to LB12 includes a plurality of LEDs 121 connected to each other in series.

In an exemplary embodiment, the first switching section 160 includes first to fourth switching sections SW1, SW2, SW3 and SW4. The first switching device SW1 includes a first electrode which receives the driving voltage $V_{LED}$, a second electrode which receives the first control signal CS1 and a third electrode connected to first terminals (e.g., anode of the first LED of each light source block) of the first to third light source blocks LB1, LB2 and LB3. The second switching device SW2 includes a first electrode which receives the driving voltage $V_{LED}$, a second electrode which receives the second control signal CS2 and a third electrode connected to first terminals of the fourth to sixth light source blocks LB4, LB5 and LB6. The third switching device SW3 includes a first electrode which receives the driving voltage $V_{LED}$, a second electrode which receives the third control signal CS2 and a third electrode connected to first terminals of the seventh to ninth light source blocks LB7, LB8 and LB9. The fourth switching device SW4 includes a first electrode which receives the driving voltage $V_{LED}$, a second electrode which receives the fourth control signal CS4 and a third electrode connected to first terminals of the tenth to twelfth light source blocks LB10, LB11 and LB12.

The second switching section 170 includes the fifth to seventh switching devices SW5, SW6 and SW7. The fifth switching device SW5 includes a first electrode connected to second terminals (e.g., cathode of the last LED of each light source block) of the first, fourth, seventh and tenth light source blocks LB1, LB4, LB7 and LB10, a second electrode which receives the fifth control signal CS5 and a third electrode which receives the reference voltage. The driving voltage $V_{LED}$ is a positive voltage, and the reference voltage may be a ground voltage or a negative voltage. The sixth switching device SW6 includes a first electrode connected to the second terminals of the second, fifth, eighth and eleventh light source blocks LB2, LB5, LB8 and LB11, a second electrode which receives the sixth control signal CS6 and a third electrode which receives the reference voltage. The seventh switching device SW7 includes a first electrode connected to the second terminals of the third, sixth, ninth and twelfth light source blocks LB3, LB6 LB9 and LB12, a second electrode which receives the seventh control signal CS7, and a third electrode which receives the reference voltage.

Referring to FIG. 5, the first to twelfth light source blocks LB1 to LB12 may be arranged in a matrix form defined by first to fourth columns c1 to c4 connected to the first to fourth switching devices SW1 to SW4, respectively, and first to third rows r1 to r3 connected to the fifth to seventh switching devices SW5 to SW7, respectively.

The first switching device SW1 connected to the first column c1 supplies the driving voltage $V_{LED}$ to the first to third light source blocks LB1 to LB3 in response to the first control signal CS1. The second switching device SW2 connected to the second column c2 supplies the driving voltage $V_{LED}$ to the fourth to sixth light source blocks LB4 to LB6 in response to the second control signal CS2. The third switching device SW3 connected to the third column c3 supplies the driving voltage $V_{LED}$ to the seventh to ninth light source blocks LB7 to LB9 in response to the third control signal CS3. The fourth switching device SW4 connected to the fourth column c4 supplies the driving voltage $V_{LED}$ to the tenth to twelfth light source blocks LB10 to LB12 in response to the fourth control signal CS4.

The fifth switching device SW5 connected to the first row r1 supplies the reference voltage to the first, fourth, seventh and tenth light source blocks LB1, LB4, LB7 and LB10 in response to the fifth control signal CS5. The sixth switching device SW6 connected to the second row r2 supplies the reference voltage to the second, fifth, eighth and eleventh light source blocks LB2, LB5, LB8 and LB11 in response to the sixth control signal CS6. The seventh switching device SW7 connected to the third row r3 supplies the reference voltage to the third, sixth, ninth and twelfth light source blocks LB3, LB6, LB9 and LB12 in response to the seventh control signal CS7.

When both of two switching devices connected to each of the light source blocks, e.g., each of the first to twelfth light source blocks LB1 to LB12, are turned on, each of the light source blocks emits light. In an exemplary embodiment, the turn-on duration of each light source block may be determined by the turn-on durations of the two switching devices connected to the light source block. More particularly, since the turn-on duration of each switching device is determined by a control signal applied thereto, the turn-on durations of the first to twelfth light source blocks LB1 to LB12 may be determined by the high level durations of the first to seventh control signals CS1 to CS7.

Figure 6:
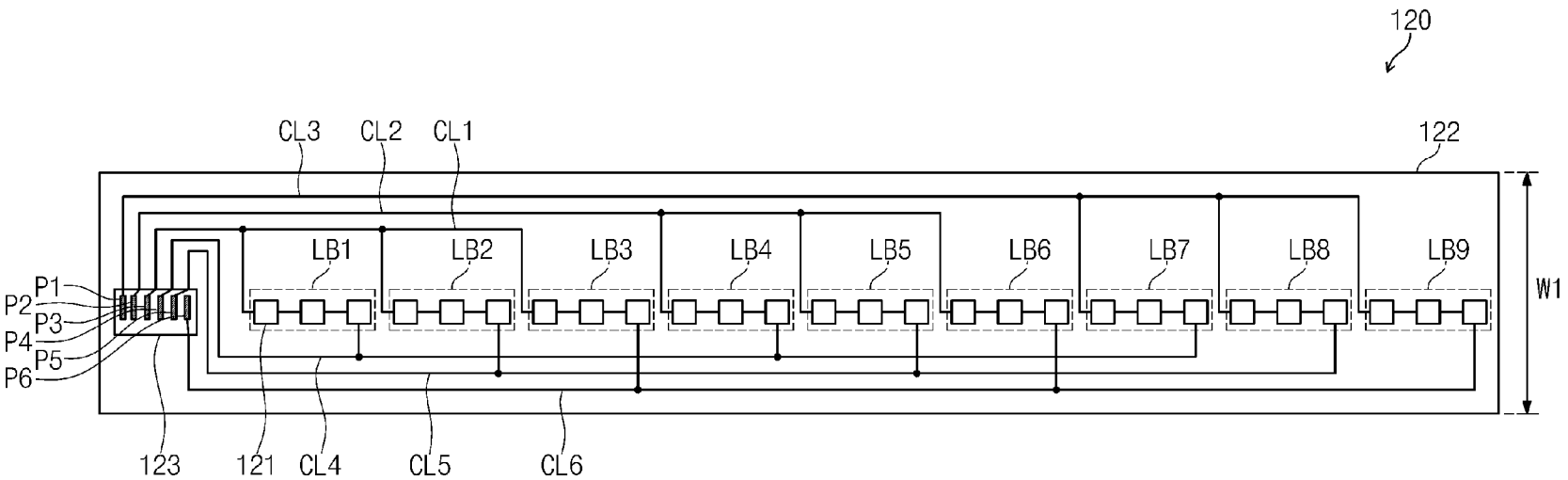
FIG. 6 is a top plan view of an exemplary embodiment of a light source unit of FIG. 1.

FIG. 6 is a top plan view of an exemplary embodiment of the light source unit 120 of FIG. 1.

Referring to FIG. 6, the light source unit 120 may include a printed circuit board 122 extending in one direction, and the first to ninth light source blocks LB1 to LB9 linearly disposed on the printed circuit board 122 along a longitudinal direction of the printed circuit board 122. LEDs 121 included in the first to ninth light source blocks LB1 to LB9 are linearly disposed on a top surface of the printed circuit board 122 along the longitudinal direction of the printed circuit board 122.

The light source unit 120 further includes a connector 123 disposed on an end portion of the printed circuit board 122. In an exemplary embodiment, the first to ninth light source blocks LB1 to LB9 of the printed circuit board 122 are electrically connected to the first and second switching sections 130 and 140, as shown in FIG. 1, via the connector 123.

The connector 123 may include pins, the number of which is greater than or equal to the sum of the number of the switching devices SW1 to SW3 of the first switching section 130 and the number of the switching devices SW4 to SW6 of the second switching section 140. In an exemplary embodiment, the connector 123 includes first to sixth pins P1 to P6 connected to the first to sixth switching devices SW1 to SW6, respectively. In an exemplary embodiment, the first to third pins P1 to P3 receive the driving voltage $V_{LED}$ according to an on/off operation of the first to third switching devices SW1 to SW3, and the fourth to sixth pins P4 to P6 receive the reference voltage according to an on/off operation of the fourth to sixth switching devices SW4 to SW6.

The printed circuit board 122 includes the first to sixth connection lines CL1 to CL6 connected to the first to sixth pins P1 to P6 of the connector 123, respectively. More particularly, the first to third connection lines CL1 to CL3 are connected to the first to third pins P1 to P3, respectively, and receive the driving voltage $V_{LED}$ therethrough. The fourth to sixth connection lines CL4 to CL6 are connected to the fourth to sixth pins P4 to P6, respectively, and receive the reference voltage therethrough.

The first connection line CL1 electrically connects the third pin P3 to the anodes of the first LEDs of the first to third light source blocks LB1 to LB3, and the first to third light source blocks LB1 to LB3 receive the driving voltage $V_{LED}$ through the first connection line CL1 when the first switching device SW1 is turned on. The second connection line CL2 electrically connects the second pin P2 to the anodes of the first LEDs of the fourth to sixth light source blocks LB4 to LB6, and the fourth to sixth light source blocks LB4 to LB6 receive the driving voltage $V_{LED}$ through the second connection line CL2 when the second switching device SW2 is turned on. The third connection line CL3 electrically connects the first pin P1 to the anodes of the first LEDs of the seventh to ninth light source blocks LB7 to LB9, and the seventh to ninth light source blocks LB7 to LB9 receive the driving voltage $V_{LED}$ through the third connection line CL3 when the third switching device SW3 is turned on.

The fourth connection line CL4 electrically connects the fourth pin P4 to the cathodes of the last LEDs of the first, fourth and seventh light source blocks LB1 LB4 and LB7, and the first, fourth, and seventh light source blocks LB1, LB4 and LB7 receive the reference voltage through the fourth connection line CL4 when the fourth switching device SW4 is turned on. The fifth connection line CL5 electrically connects the fifth pin P5 to the cathodes of the last LEDs of the second, fifth and eighth light source blocks LB2, LB5 and LB8, and the second, fifth, and eighth light source blocks LB2, LB5, and LB6 receive the reference voltage through the fifth connection line CL5 when the fifth switching device SW5 is turned on. The sixth connection line CL6 electrically connects the sixth pin P6 to the cathodes of the last LEDs of the third, sixth and ninth light source blocks LB3, LB6 and LB9, and the third, sixth and ninth light source blocks LB3, LB6 and LB9 receive the reference voltage through the sixth connection line CL6 when the sixth switching device SW6 is turned on.

In an exemplary embodiment, when nine light source blocks, e.g., the first to ninth light source blocks LB1 to LB9, are disposed on the printed circuit board 122, the printed circuit board 122 includes the six connection lines, e.g., the first to sixth connection lines CL1 to CL6, as shown in FIG. 6, but the number of connection lines is not limited thereto. In an alternative exemplary embodiment, when the number of light source blocks is increased to twelve, the number of connection lines may be increased to seven. Therefore, when the number of the light source blocks is p, the printed circuit board 122 includes various numbers of connection lines, the number of which is less than p. The number of the connection lines of the printed circuit board 122 may be set to be equal to the smallest value among all possible sums of two divisors of p, where a product of the two divisors is equal to p.

As described above, when the number of the connection lines of the printed circuit board 122 is less than the number of the light source blocks, the whole width w1 of the printed circuit board 122 may be substantially reduced, and the size of the backlight unit 100 may be thereby reduced.

Figure 7:
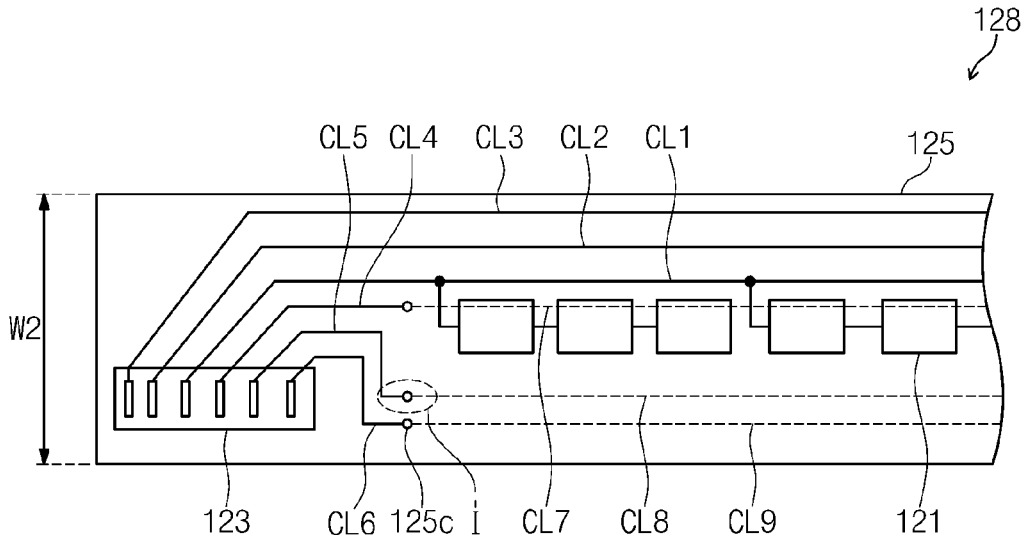
FIG. 7 is a top plan view of an alternative exemplary embodiment of a light source unit according to the present invention.
Figure 8:
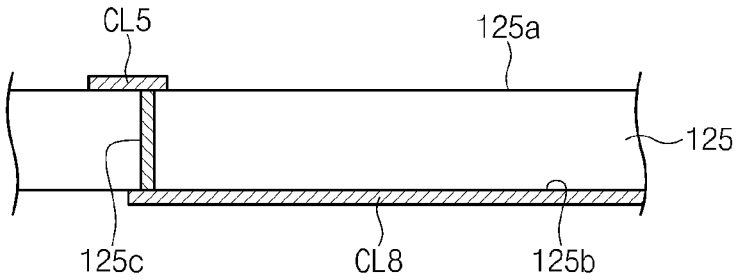
FIG. 8 is a cross-sectional view of portion I in FIG. 7.

FIG. 7 is a top plan view of an alternative exemplary embodiment of a light source unit 128 according to the present invention. FIG. 8 is a cross-sectional view of portion I of FIG. 7.

Referring to FIGS. 7 and 8, the light source unit 128 includes a double-sided printed circuit board 125. The double-sided printed circuit board 125 may include connection lines, e.g., the first to fifth connection lines CL1 to CL5, on a top surface 125*a* thereof, on which the LEDs 121 are disposed, and connection lines, e.g., sixth to ninth CL6 to CL9, disposed on a bottom surface 125*b* opposite to the top surface 125*a*.

In an exemplary embodiment, the connector 123 is disposed on the top surface 125*a* of the double-sided printed circuit board 125. In an exemplary embodiment, the first to sixth connection lines CL1 to CL6 are disposed on the top surface 125*a* of the double-sided printed circuit board 125, and the first to sixth connection lines CL1 to CL6 are thereby electrically connected to the first to sixth pins P1 to P6 of the connector 123.

The first to third connection lines CL1 to CL3 among the first to sixth connection lines CL1 to CL6 extend in an arrangement direction of the LEDs 121, in which the LEDs 121 are arranged, on the top surface 125*a* of the double-sided printed circuit board 125. The fourth to sixth connection lines CL4 to CL6 among the first to sixth connection lines CL1 to CL6 are electronically connected to the seventh to ninth connection lines CL7 to CL9, respectively, extending in the arrangement direction of the LEDs 121 on the bottom surface 125*b* of the double-sided printed circuit board 125. The double-sided printed circuit board 125 includes via holes 125*c* formed therethrough. The fourth to sixth connection lines CL4 to CL6 are electrically connected to the seventh to ninth connection lines CL7 to CL9, respectively, through the via holes 125*c* corresponding thereto.

When the light source unit 128 includes the double-sided printed circuit board 125, since the seventh to ninth connection lines CL7 to CL9 may overlap the LEDs 121, the width w2 of the double-sided printed circuit board 125 may be substantially less than the width w1 of the printed circuit board 122 shown in FIG. 6.

In an exemplary embodiment, the light source unit 128 includes the double-sided printed circuit board 125, as shown in FIGS. 7 and 8, but not being limited thereto. In an alternative exemplary embodiment, the light source units 120 and 128 may include a multiple-layer printed circuit board (not shown), for example. In an exemplary embodiment, the connection lines CL1 to CL6 may be distributed into each layer of the multiple-layer printed circuit board.

In an exemplary embodiment, the printed circuit boards 122 and 125 may include a metallic material. Since a metallic printed circuit board has thermal conductivity higher than thermal conductivity of a plastic printed circuit board, the metallic printed circuit board may dissipate heat emitted from the LEDs 121 more efficiently than the plastic printed circuit board.

Figure 9:
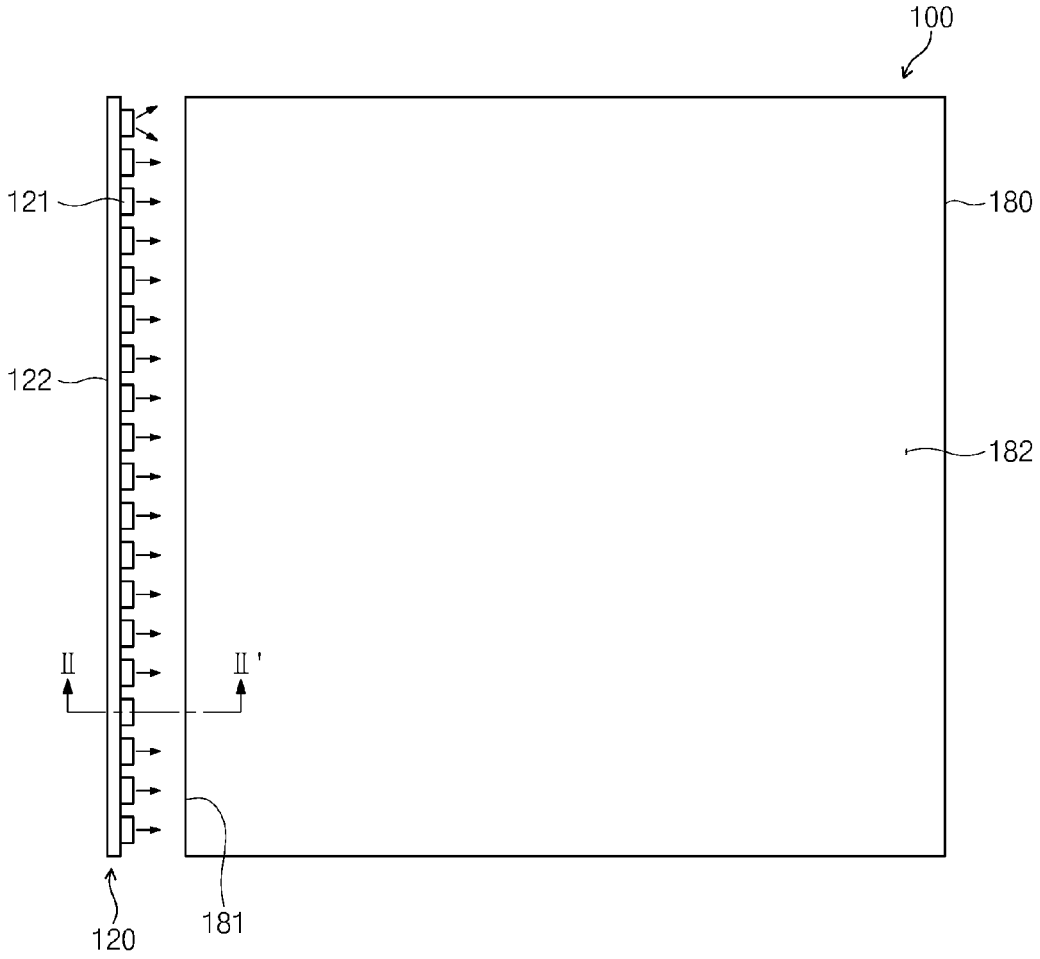
FIG. 9 is a top plan view of an exemplary embodiment of a backlight unit including the light source unit of FIG. 6.
Figure 10:
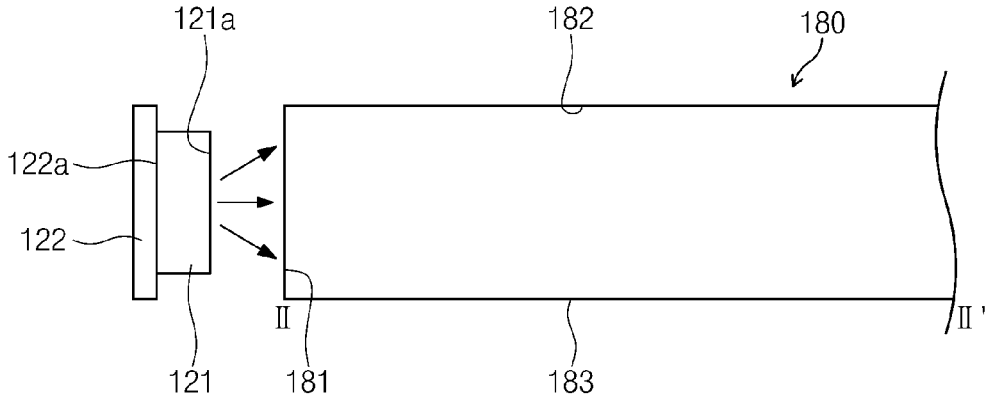
FIG. 10 is a cross-sectional view taken along line II-II' of FIG. 9.

FIG. 9 is a top plan view of an exemplary embodiment of the backlight unit 100 including the light source unit 120 of FIG. 6. FIG. 10 is a cross-sectional view taken along line II-II' of FIG. 9.

Referring to FIGS. 9 and 10, the backlight unit 100 may include the light source unit 120 and a light guide plate 180. The light source unit 120 of FIGS. 9 and 10 is substantially the same as the light source unit shown in FIG. 6, and any repetitive detailed description of the light source unit 120 will hereinafter be omitted.

In an exemplary embodiment, the light guide plate 180 has a plate-like shape, e.g., a rectangular plate-like shape as shown in FIG. 9. In an exemplary embodiment, the light guide plate 180 includes a lateral surface 181 disposed adjacent to the light source unit 120, an exit surface 182 extending from one end of the lateral surface 181, and a reflective surface 183 disposed substantially parallel to the exit surface 182 and extending from an opposite end of the lateral surface 181.

Light output from the light source unit 120 is incident onto the lateral surface 181 of the light guide plate 180. The light that has been incident into the light guide plate 180 through the lateral surface 181 is transmitted to the outside through the exit surface 182 or reflected by the reflective surface 183 before the light is transmitted to the exit surface 182. The light that is not reflected by the reflective surface 183 but leaked through the reflective surface 183 may be reflected again toward the light guide plate 180 by a reflective plate or a reflective sheet (not shown) which may be disposed below the light guide plate 180.

In an exemplary embodiment, the backlight unit 100 includes one light source unit 120 disposed adjacent to one lateral surface of the light guide plate 180, as shown in FIG. 9, but not being limited thereto. In an alternative exemplary embodiment, the backlight unit 100 may include at least two light source units disposed adjacent to at least two lateral surfaces of the light guide plate 180, respectively, for example.

As shown in FIG. 10, the LEDs 121 disposed on the printed circuit board 122 include a light emission surface 121*a* to output light. In an exemplary embodiment, the light emission surface 121*a* may be substantially parallel to a top surface 122*a* of the printed circuit board 122. In an exemplary embodiment, the light emission surface 121*a* and the top surface 122*a* of the printed circuit board 122 may be substantially parallel to the lateral surface 181 of the light guide plate 180.

Figure 11:
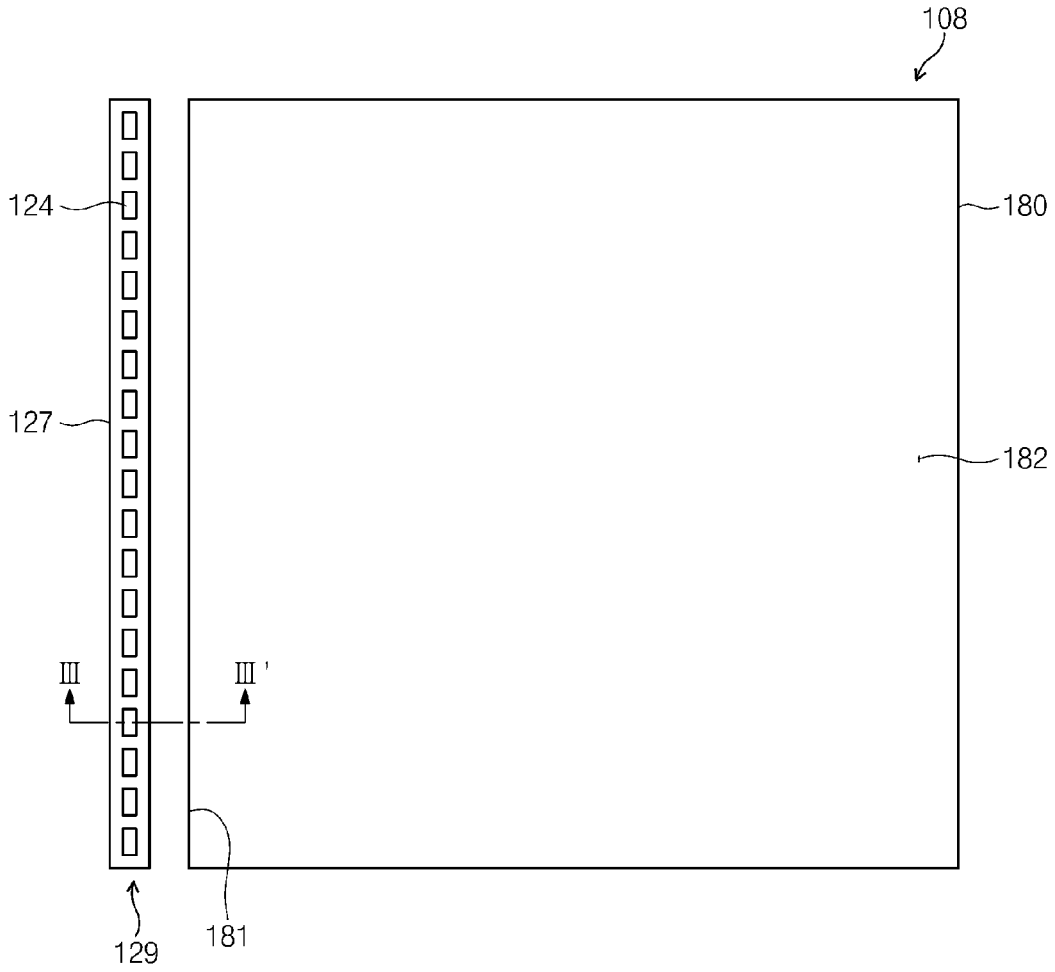
FIG. 11 is a top plan view of an alternative exemplary embodiment of a backlight unit according to the present invention.
Figure 12:
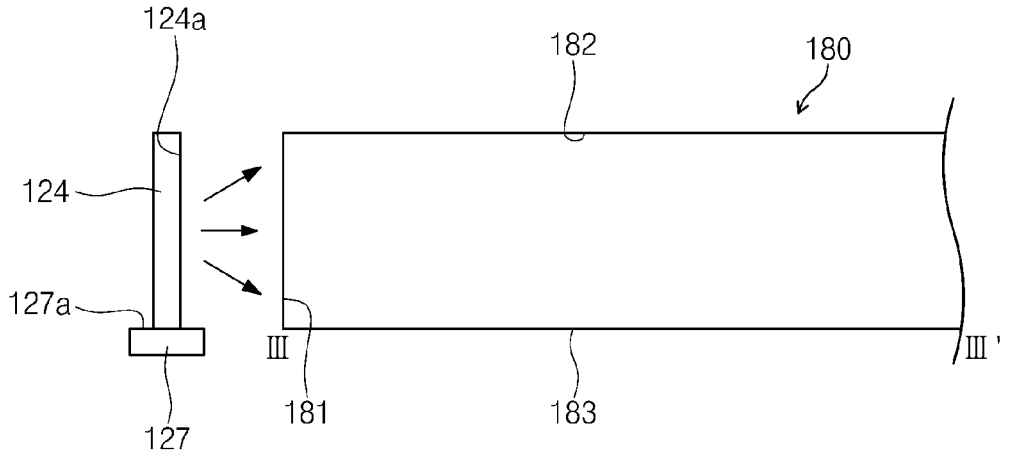
FIG. 12 is a cross-sectional view taken along line III-III' of FIG. 11.

FIG. 11 is a top plan view of an alternative exemplary embodiment of a backlight unit 108 according to the present invention, and FIG. 12 is a cross-sectional view taken along line III-III' of FIG. 11.

Referring to FIGS. 11 and 12, the backlight unit 108 may include a light source unit 129 and the light guide plate 180. The light guide plate 180 is substantially the same as the light guide plate shown in FIGS. 9 and 10, and any repetitive detailed description thereof will hereinafter be omitted.

In an exemplary embodiment, the light source unit 129 includes a printed circuit board 127 disposed parallel to the reflective surface 183 of the light guide plate 180. More particularly, a top surface 127*a* of the printed circuit board 127 is disposed substantially parallel to the reflective surface 183 of the light guide plate 180 and substantially perpendicular to the lateral surface 181 of the light guide plate 180. LEDs 124 are disposed on the top surface 127*a* of the printed circuit board 127. Light emission surfaces 124*a* of the LEDs 124 are disposed substantially perpendicular to the top surface 127*a* of the printed circuit board 127 and substantially parallel to the lateral surface 181 of the light guide plate 180.

In an exemplary embodiment, the backlight unit includes a one dimensional local dimming structure in which light source blocks are linearly arranged in one direction, as shown in FIGS. 6 to 12, but are not being limited. In an alternative exemplary embodiment, the backlight unit may include multi-dimensional local dimming structure, for example.

Figure 13:
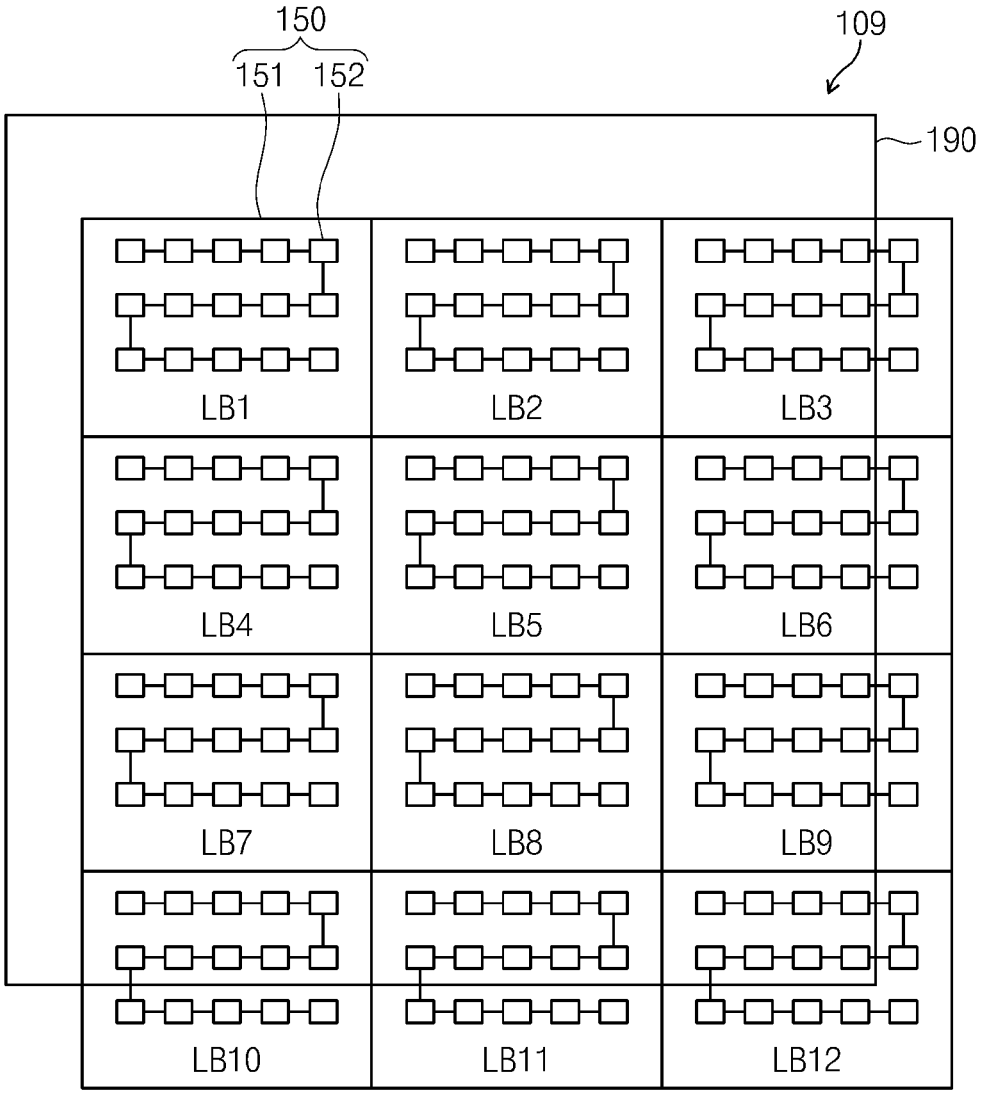
FIG. 13 is a top plan view of an alternative exemplary embodiment of a backlight unit according to the present invention.

FIG. 13 is a top plan view of an alternative exemplary embodiment of a backlight unit 109 according to the present invention.

Referring to FIG. 13, the backlight unit 109 may have a two dimensional local dimming structure in which light source blocks are arranged in two directions. In an exemplary embodiment, the backlight unit 109 includes a light source unit 150 and a diffusion plate 190. The light source unit 150 includes a printed circuit board 151 disposed below the diffusion plate 190 and a plurality of light source blocks LB1 to LB12 disposed on the printed circuit board 151. In an exemplary embodiment, the light source blocks LB1 to LB12 may be arranged in the form of a 3×4 matrix.

The light source blocks LB1 to LB12 may include a plurality of light sources 152, and each light source may include LEDs.

Figure 14:
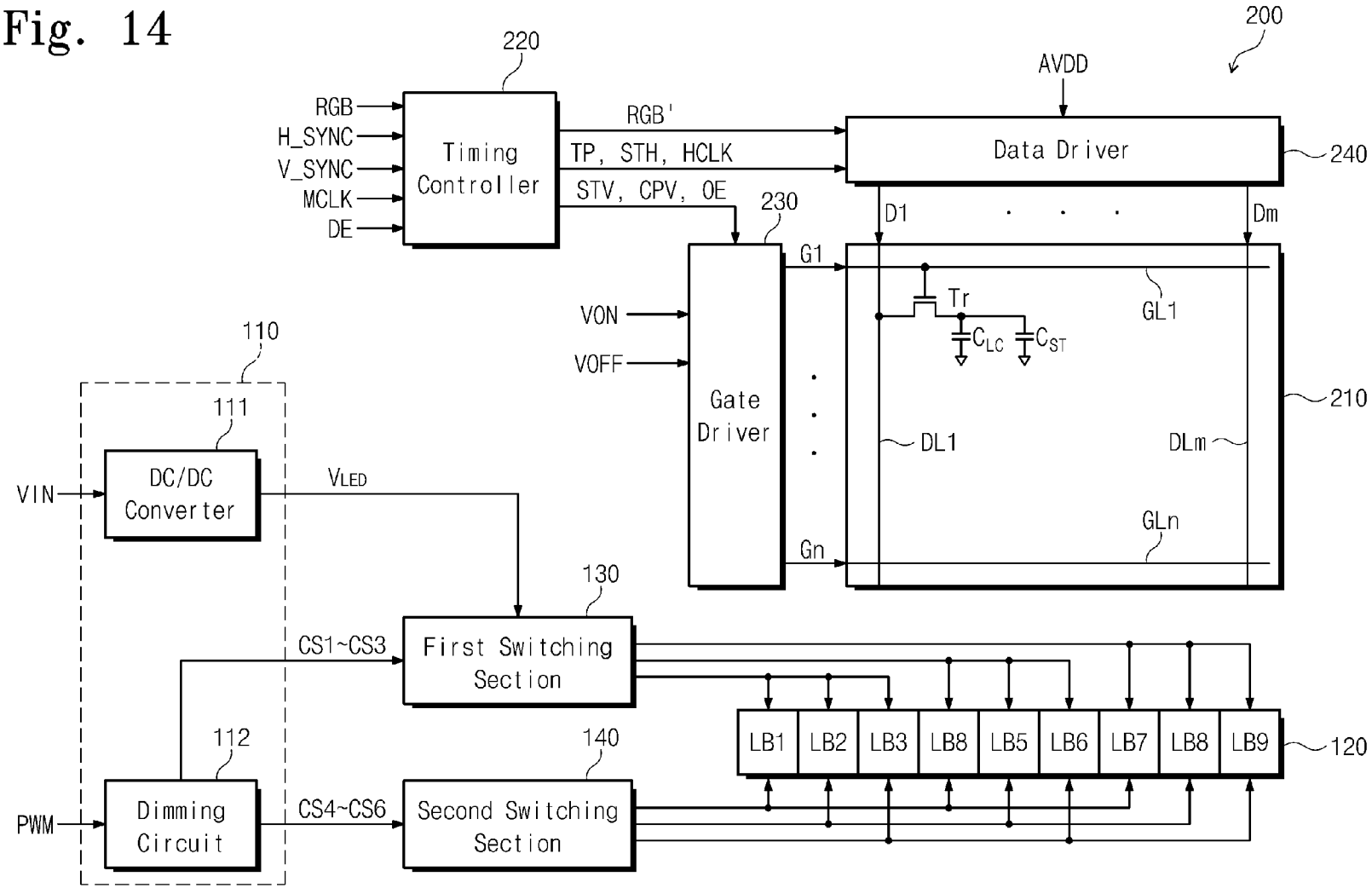
FIG. 14 is a block diagram of an exemplary embodiment of a display apparatus according to the present invention.

FIG. 14 is a block diagram showing an exemplary embodiment of a display apparatus 200 according to the present invention.

Referring to FIG. 14, the display apparatus 200 may include a liquid crystal display panel 210, a timing controller 220, a gate driver 230, a data driver 240, the driving circuit 110, the light source unit 120, the first switching section 130 and the second switching section 140. The driving circuit 110 includes the voltage boosting circuit (e.g., DC/DC converter 111) and the dimming circuit 112.

The liquid crystal display panel 210 includes a plurality of gate lines, e.g., first to n-th gate lines GL1 to GLn, a plurality of data lines, e.g., first to m-th data lines DL1 to DLm, crossing the plurality of gate lines, e.g., the first to n-th gate lines GL1 to GLn, and pixels provided in regions corresponding to the plurality of gate lines, e.g., the first to n-th gate lines GL1 to GLn, and the plurality of data lines, e.g., the first to m-th data lines DL1 to DLm. As shown in FIG. 14, each pixel includes a thin film transistor Tr having gate and source electrodes connected to corresponding gate lines and corresponding data line, respectively, a liquid crystal capacitor $C_{LC}$ connected to a drain electrode of the thin film transistor Tr, and a storage capacitor $C_{ST}$.

The timing controller 220 receives an image data signal RGB, a horizontal sync signal H_SYNC, a vertical sync signal V_SYNC, a clock signal MCLK, and a data enable signal DE from an external device. The timing controller 220 converts a data format of the image data signal RGB into another data format based on an interface between the timing controller 220 and the data driver 240 and thereby outputs a converted image data signal RGB' to the data driver 240. In addition, the timing controller 220 outputs data control signals (e.g., an output start signal TP, a horizontal start signal STH, and a clock signal HCLK) to the data driver 240, and outputs gate control signals (e.g., a vertical start signal STV, a gate clock signal CPV, and an output enable signal OE) to the gate driver 230.

The gate driver 230 receives a gate-on voltage VON and a gate-off voltage VOFF to sequentially output gate signals G1 to Gn having the gate-on voltage VON in response to the gate control signals, e.g., the vertical start signal STV, the gate clock signal CPV, and the output enable signal OE, provided from the timing controller 220. The gate signals G1 to Gn are sequentially applied to the gate lines GL1 to GLn of the liquid crystal display panel 210 to sequentially scan the gate lines GL1 to GLn. In an alternative exemplary embodiment, the display apparatus 200 may further include a regulator (not shown) to convert an input voltage $V_{IN}$ to the gate-on voltage VON and the gate-off voltage VOFF to be output, and the regulator may receive a voltage different from the input voltage $V_{IN}$ supplied from the DC/DC converter 111.

The data driver 240 may receive an analog driving voltage AVDD and generate a plurality of grayscale voltages using gamma voltages supplied from a gamma voltage generator (not shown). The data driver 240 selects grayscale voltages corresponding to the image data signal RGB' among the grayscale voltages in response to the data control signals, e.g., the output start signal TP, the horizontal start signal STH, and the clock signal HCLK supplied from the timing controller 220. The data driver 240 applies the grayscale voltages as the data signals D1 to Dm to the data lines DL1 to DLm of the liquid crystal display panel 210.

When the gate signals G1 to Gm are sequentially applied to the gate lines GL1 to GLn, the data signals D1 to Dm are applied to the plurality of data lines, e.g., the first to m-th data lines DL1 to DLm, in synchronization with the gate signals G1 to Gm. When a gate signal is applied to a gate line, the thin film transistor Tr connected to the gate line is turned on in response to the gate signal. When a data signal is applied to a data line connected to the thin film transistor Tr that has been turned on, the data signal is charged in the liquid crystal capacitor $C_{LC}$ and the storage capacitor $C_{ST}$ through the thin film transistor Tr that has been turned on.

The liquid crystal capacitor $C_{LC}$ adjusts light transmittance of liquid crystal according to the charged voltage. When the thin film transistor Tr is turned on, the storage capacitor $C_{ST}$ is charged with the data signal. When the thin film transistor Tr is turned off, the data signal, which has been charged in the storage capacitor $C_{ST}$, is applied to the liquid crystal capacitor $C_{LC}$, and the charge of the liquid crystal capacitor $C_{LC}$ is thereby substantially maintained. Accordingly, the liquid crystal display panel 210 displays an image using the scheme described above.

In an exemplary embodiment, the light source unit 120 includes the first to ninth light source blocks LB1 to LB9 disposed at one side of the liquid crystal display panel 110. The first switching section 130 may supply the driving voltage $V_{LED}$ to at least two light source blocks selected among the first to ninth light source blocks LB1 to LB9 in response to the first to third control signals CS1 to CS3 supplied from the dimming circuit 112. The second switching section 140 may supply the reference voltage (e.g., ground voltage) to the first to ninth light source blocks LB1 to LB9 in response to the first to third control signals CS4 to CS6 supplied from the dimming circuit 112. In an exemplary embodiment, the second switching section 140 may apply the reference voltage to at least one of the at least two light source blocks connected thereto. Accordingly, the light may be output from at least one light source block to which the driving voltage $V_{LED}$ and the reference voltage are applied.

In an exemplary embodiment, an amount of light emitted from the first to ninth light source blocks LB1 to LB9 may be adjusted according to the time periods of the high level durations of the first to sixth control signals CS1 to CS6.

Figures 15, 16:
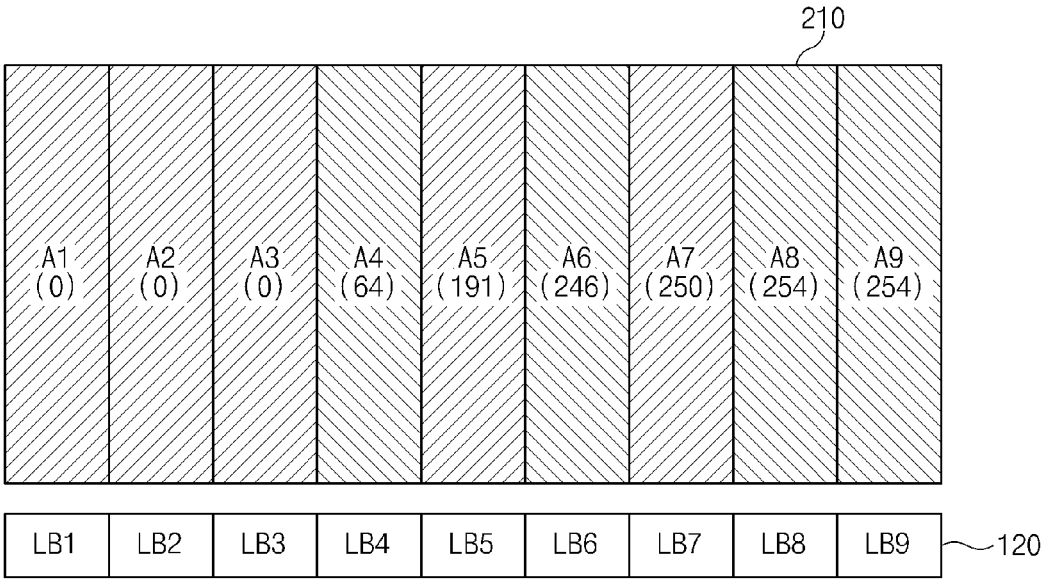
FIG. 15 is a block diagram showing a corresponding relation between a light source unit and a liquid crystal display panel of FIG. 14.
FIG. 16 is a table representing the brightness of first to ninth light source blocks of FIG. 15.

FIG. 15 is a block diagram showing a corresponding relation between the light source unit 120 and the liquid crystal display panel 210 of FIG. 14, and FIG. 16 is a table representing the brightness of the first to ninth light source blocks LB1 to LB9 of FIG. 15.

Referring to FIGS. 15 and 16, the liquid crystal display panel 120 may be divided into first to ninth dimming regions A1 to A9 corresponding to the first to ninth light source blocks LB1 to LB9 of the light source unit 120, respectively. The number of the dimming regions A1 to A9 defined in the liquid crystal display panel 210 may vary depending on the number of the light source blocks. In an exemplary embodiment, when twelve light source blocks are included in the light source unit 120, the liquid crystal display panel 210 may be divided into twelve dimming regions.

When the dimming signal PWM applied to the dimming circuit 112 is represented by 8 bits, and an image displayed in the first to ninth dimming regions A1 to A9 defined in the liquid crystal display panel 210 is converted to a representative brightness value of the image, the image may be expressed in 256 levels (0-255). In an exemplary embodiment, the first to third diming regions A1 to A3 among the first to ninth dimming regions A1 to A9 may have a representative brightness value of 0, the fourth dimming region A4 may have a representative brightness value of 64 and the fifth dimming region A5 may have a representative brightness value of 191. The sixth dimming region A6 may have a representative brightness value of 246, the seventh dimming region A7 may have a representative brightness value of 250 and the eighth and ninth dimming regions A8 and A9 may have a representative brightness value of 254.

The turn-on durations of the first to sixth switching devices SW1 to SW6 may be adjusted to control an amount of the light emitted from the first to ninth light source blocks LB1 to LB9 corresponding to the first to ninth dimming regions A1 to A9. In an exemplary embodiment, as shown in FIG. 16, the turn-on durations of the first to sixth switching devices SW1 to SW6 may be expressed in 256 values corresponding to 256 brightness levels.

As shown in FIG. 16, the turn-on duration of the first switching device SW1 may have a time period of 0, the turn-on duration of the second switching device SW2 may have a time period of 246 and the turn-on duration of the third switching device SW3 may have a time period of 254. In addition, the turn-on duration of the fourth switching device SW4 may have a time period of 250, the turn-on duration of the fifth switching device SW5 may have a time period of 254 and the turn-on duration of the sixth switching device SW6 may have a time period of 254.

When the turn-on duration of the first switching device SW1 has a time period of 0, the first to third light source blocks LB1 to LB3 connected to the first switching device SW1 are turned off. The fourth light source block LB4 is turned on for the duration of 246 corresponding to a smaller duration of the turn-on duration of the second switching device SW2 and the turn-on duration of the fourth switching device SW4. The fifth light source block LB5 is turned on for the duration of 246 corresponding to a smaller duration of the turn-on duration of the second switching device SW2 and the turn-on duration of the fifth switching device SW5. The sixth light source block LB6 is turned on for the duration of 246 corresponding to a smaller duration of the turn-on duration of the second switching device SW2 and the turn-on duration of the sixth switching device SW6.

The seventh light source block LB7 is turned on for the duration of 250 corresponding to a smaller duration of the turn-on duration of the third switching device SW3 and the turn-on duration of the fourth switching device SW4. Since the turn-on durations of the third, fifth and sixth switching devices SW3, SW5 and SW6 have the same time period, the eighth and ninth light source blocks LB8 and LB9 are turned on for the duration of 254.

Data shown in FIG. 16 are provided as an example for an illustrative purpose. When the brightness levels of the first to ninth dimming regions A1 to A9 of the liquid crystal display panel 210 are changed, the turn-on durations of the first to ninth light source blocks LB1 to LB9 may be changed.

As described above, the display apparatus 200 may employ a dimming scheme by controlling an amount of light emitted from the first to ninth light source blocks LB1 to LB9 according to the time periods of the turn-on durations of the first to sixth switching blocks SW1 to SW6.

Figure 17:
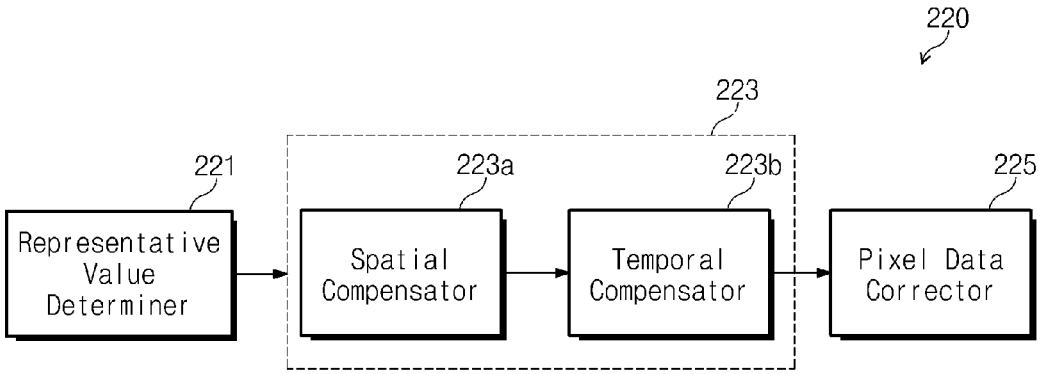
FIG. 17 is a block diagram of an exemplary embodiment of a timing controller shown in FIG. 14.

FIG. 17 is a block diagram of an exemplary embodiment of the timing controller 220 of FIG. 14.

Referring to FIG. 17, the timing controller 200 may include a representative value determiner 221, a representative value compensator 223 and a pixel data corrector 225.

The representative value determiner 221 determines representative brightness values of the first to ninth light source blocks LB1 to LB9 based on external image signals supplied to the first to ninth dimming regions A1 to A9 of the liquid crystal display panel 210 corresponding to the first to ninth light source blocks LB1 to LB9. The representative value compensator 223 calculates brightness compensation values by compensating the representative brightness values. The brightness compensation values calculated from the representative value compensator 223 are supplied to the pixel data corrector 225. The pixel data corrector 225 applies distance weights to the boundary regions between the first to ninth light source blocks LB1 to LB9 based on the brightness compensation values to correct pixel data of the image signal RGB. Then, the corrected pixel data may be provided to the data driver 240.

In an exemplary embodiment, the representative value determiner 221 extracts representative brightness values of the first to ninth light source blocks LB1 to LB9 using the control signal CS and the image signal RGB input from the outside corresponding to the first to ninth dimming regions A1 to A9 divided based on the first to ninth light source blocks LB1 to LB9. Each representative brightness value may be a middle value in a range between the maximum brightness value and an average brightness value of the image signal RGB of each image block.

The representative value compensator 223 may include a spatial compensator 223*a* to low-pass filter the representative brightness values of the first to ninth light source blocks LB1 to LB9. The spatial compensator 223*a* may calculate brightness compensation values for the first to ninth light source blocks LB1 to LB9 based on the maximum value of the representative brightness values obtained from a specific light source block and other light source blocks adjacent to the specific light source block.

In an exemplary embodiment, if a representative brightness value of the specific light source block is less than the product of a compensation ratio and the highest value (e.g., the maximum representative brightness value) of the representative brightness values obtained from the specific light source block and the light source blocks adjacent to the specific light source block, the spatial compensator 223*a* may calculate the brightness compensation values for the specific light source block by compensating the representative brightness value of the specific light source block such that the representative brightness value of the specific light source block is greater than the product of the compensation ratio and the maximum representative brightness value. Accordingly, the representative brightness values of the first to ninth light source blocks LB1 to LB9 may be substantially gradually decreased or increased without a steep variation.

In an exemplary embodiment, the representative value compensator 223 may further include a temporal compensator 223*b* to low-pass filter the representative brightness value of each of the first to ninth light source blocks LB1 to LB9 in the unit of each frame of the image signal RGB.

When a moving picture with a steep variation in brightness is displayed, a flicker phenomenon occurs between frames of the image signal RGB since the brightness of the first to ninth light source blocks LB1 to LB9 may be instantly changed. In an exemplary embodiment, the representative brightness values of the first to ninth light source blocks LB1 to LB9 are low-pass filtered with respect to a temporal axis, thereby restricting the variation of the representative brightness values of the first to ninth light source blocks LB1 to LB9.

The representative value compensator 223 may include one of the spatial compensator 223*a*, which low-pass filters the representative brightness value of each of the first to ninth light source blocks LB1 to LB9 with respect to a spatial axis, and the temporal compensator 223*b* which low-pass filters the representative brightness value of each of the light source blocks LB1 to LB9 with respect to the a temporal axis. When the representative value compensator 223 includes both of the spatial compensator 223*a* and the temporal compensator 223*b*, the arrangement of the spatial compensator 223*a* and the temporal compensator 223*b* is not limited to a specific arrangement.

The representative value compensator 223 calculates a brightness compensation value obtained by compensating each representative brightness value and provides the brightness compensation value to the pixel data corrector 225. The pixel data corrector 225 corrects pixel data to prevent the whole screen from becoming dark due to dimming of a backlight unit, thereby increasing the brightness of an image. The pixel data corrector 225 applies distance weights to boundary regions between the first to ninth light source blocks LB1 to LB9 based on brightness compensation values obtained from the representative value compensator 223, and the pixel data of the image signal RGB is thereby effectively corrected.

In an exemplary embodiment, the pixel data corrector 225 sets a portion of a light emitting block adjacent to the light source blocks LB1 to LB9 as a boundary region and sets a remaining region as a central region, and a specific pixel correction scheme is thereby employed for each region. The central region is pixel-corrected based on the brightness compensation value provided from the representative value compensator 223, and the boundary region is pixel-corrected based on a value estimated by applying a distance weight to the brightness compensation value, and steep brightness variation between the first to ninth light source blocks LB1 to LB9 is thereby substantially reduced.

In an exemplary embodiment, the pixel data corrector 225 may correct pixel data of an image signal applied to each of the first to ninth dimming regions A1 to A9 according to the difference between a real dimming level and a target dimming level of each of the first to ninth light source blocks LB1 to LB9 when the real dimming level is different from the target dimming level.

In particular, as shown in FIGS. 15 and 16, even though the target dimming level of the fourth light source block LB4 is calculated as 64, the real dimming level of the fourth light source block LB4 is measured as 246. In this case, since the real dimming level is greater than the target dimming level, the fourth dimming region A4 of the liquid crystal display panel 210 corresponding to the fourth light source block LB4 may have a real brightness value greater than a target brightness value. Accordingly, the pixel data corrector 225 corrects a brightness value of the image signal applied to the fourth dimming region A4 to lower the brightness value.

In contrast, when a real dimming level of a predetermined light source block of the first to ninth light source blocks LB1 to LB9 is less than a target dimming level, the pixel data corrector 225 may correct a brightness value of an image signal applied to the dimming region corresponding to the light source block to increase the brightness value.

As described above, when the first to ninth light source blocks LB1 to LB9 have real dimming levels different from the target dimming levels, the pixel data corrector 225 corrects the pixel data of the image signal applied to the first to ninth dimming regions A1 to A9 according to the difference between the real and target dimming levels, and a dimming effect is thereby substantially improved.

Figure 18:
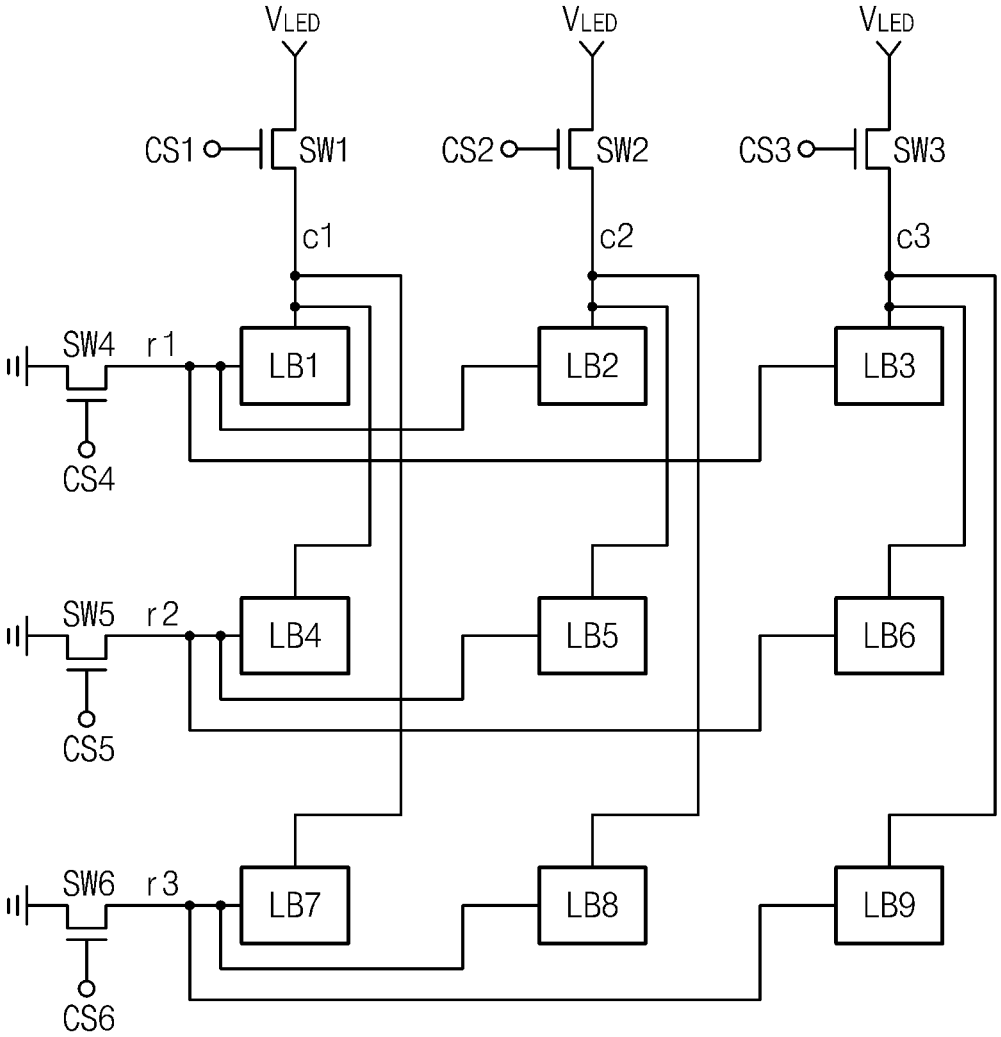
FIG. 18 is a schematic circuit diagram of an alternative exemplary embodiment of first to sixth switching devices and first to ninth light source blocks, showing connections therebetween.
Figure 19:
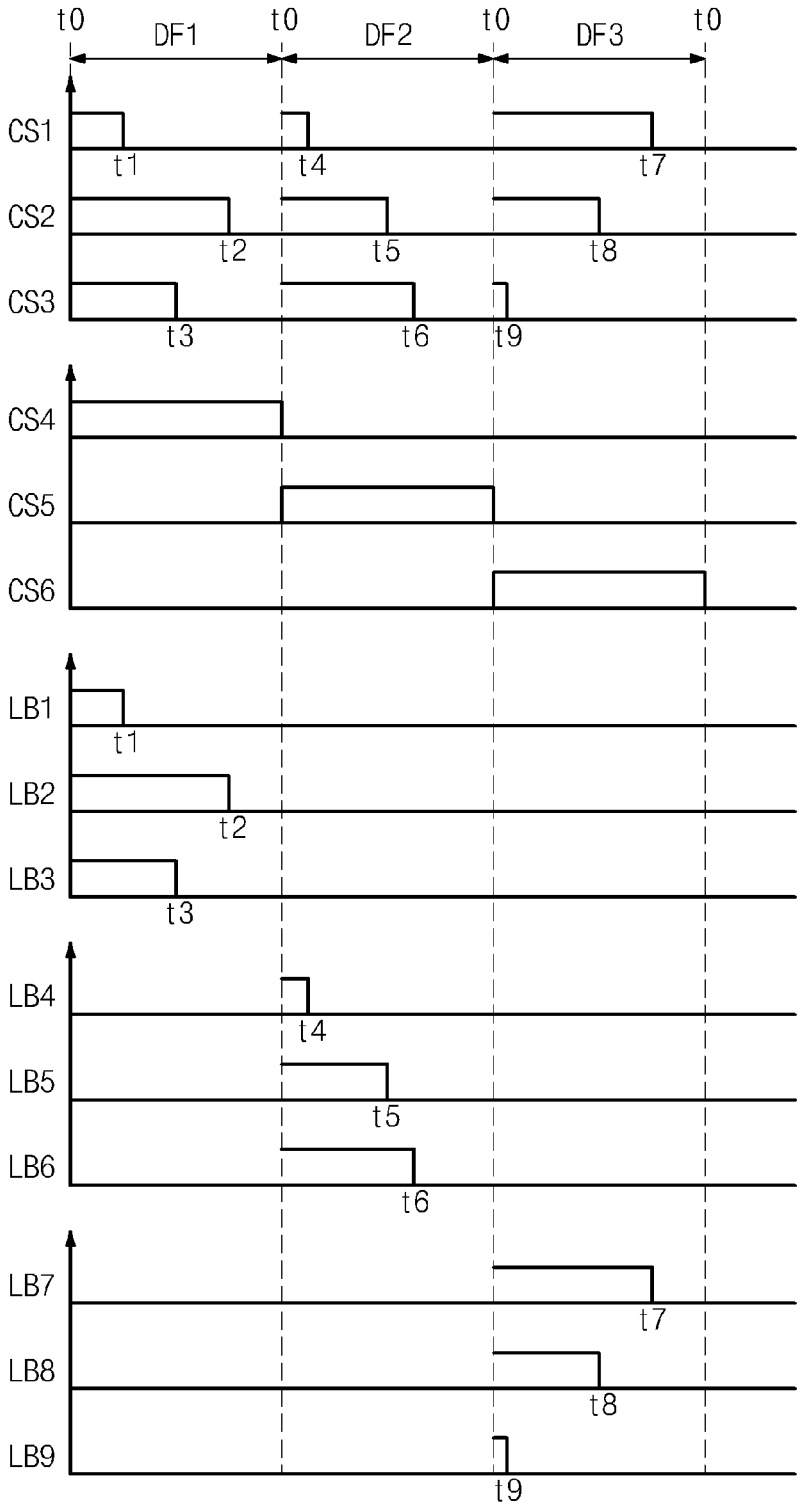
FIG. 19 is a signal timing diagram showing the turn-on durations of first to ninth light source blocks according to the high level durations of first to sixth control signals shown in FIG. 18.

FIG. 18 is a schematic circuit diagram of an alternative exemplary embodiment of the first to sixth switching devices SW1 to SW6 and the first to ninth light source blocks LB1 to LB9, showing connections therebetween, and FIG. 19 is a signal timing diagram showing the turn-on durations of the first to ninth light source blocks LB1 to LB9 according to the high level durations of the first to sixth control signals of FIG. 18.

Referring to FIG. 18, the first to ninth light source blocks LB1 to LB9 may be arranged in a matrix form defined by first to third columns c1 to c3 connected to the first to third switching devices SW1 to SW3 and first to third rows r1 to r3 connected to the fourth to sixth switching devices SW4 to SW6.

The first switching device SW1 connected to the first column c1 supplies the driving voltage $V_{LED}$ to the first light source block LB1, the fourth light source block LB4 and the seventh light source block LB7 in response to the first control signal CS1. The second switching device SW2 connected to the second column c2 supplies the driving voltage $V_{LED}$ to the second light source block LB2, the fifth light source block LB5 and the eighth light source block LB8 in response to the second control signal CS2. The third switching device SW3 connected to the third column c3 supplies the driving voltage $V_{LED}$ to the third light source block LB3, the sixth light source block LB6 and the ninth light source block LB9 in response to the third control signal CS3.

The fourth switching device SW4 connected to the first row r1 supplies the reference voltage to the first to third light source blocks LB1 to LB3 in response to the fourth control signal CS4. The fifth switching device SW5 connected to the second row r2 supplies the reference voltage to the fourth to sixth light source blocks LB4 to LB6 in response to the fifth control signal CS5. The sixth switching device SW6 connected to the third row r3 supplies the reference voltage to the seventh to ninth light source blocks LB7 to LB9 in response to the sixth control signal CS6.

In an exemplary embodiment, when two switching devices connected to each light source block are turned on, the light source block operates to output light. The turn-on duration of each light source block is determined by a control signal applied to two switching devices connected to the light source block.

FIG. 19 a signal timing diagram showing the turn-on duration of each of the first to ninth light source blocks LB1 to LB9 according to the high level duration of each of the first to sixth control signals CS1 to CS6 in FIG. 18.

Referring to FIG. 19, in the first dimming frame DF1, the high level duration of the first control signal CS1 is set from the zero time t0 to the first time t1, the high level duration of the second control signal CS2 is set from the zero time t0 to the second time t2, and the high level duration of the third control signal CS3 is set from the zero time t0 to the third time t3. As shown in FIG. 19, the zero time t0 is defined as a starting time point of each dimming frame.

The high level duration of the fourth control signal CS4 is set throughout the whole duration of the first dimming frame DF1. In contrast, the fifth and sixth control signals CS5 and CS6 are maintained at a low state in the first dimming frame DF1.

Accordingly, only the first to third light source blocks LB1 to LB3 among the first to ninth light source blocks LB1 to LB9 may be turned on in the first dimming frame DF1. In detail, the first light source block LB1 is turned on for a time period during which the high level duration of the first control signal CS1 is overlapped with the high level duration of the fourth control signal CS4, e.g., the duration from the zero time t0 to the first time t1. In addition, the fourth light source block LB4 is turned on for a time period during which the high level duration of the second control signal CS2 is overlapped with the high level duration of the fourth control signal CS4, e.g., the duration from the zero time t0 to the second time t2. The seventh light source block LB7 is turned on for a time period during which the high level duration of the third control signal CS3 is overlapped with the high level duration of the fourth control signal CS4, e.g., the duration from the zero time t0 to the third time t3.

As shown in FIG. 19, when the second dimming frame DF2 begins, the sixth control signal CS6 is maintained at a low state, the fourth control signal CS4 is changed into a low state, and the fifth control signal CS5 is changed into a high state. The high state of the fifth control signal CS5 is maintained during the whole duration of the second dimming frame DF2.

In the second dimming frame DF2, the high level duration of the first control signal CS1 is set from the zero time t0 to the fourth time t4, the high level duration of the second control signal CS2 is set from the zero time t0 to the fifth time t5, and the high level duration of the control signal CS3 is set from the zero time t0 to the sixth time t6.

Accordingly, only the fourth to sixth light source blocks LB4 to LB6 among the first to ninth light source blocks LB1 to LB9 are turned on in the second dimming frame DF2. In detail, the fourth light source block LB4 is turned on for a time period during which the high level durations of the first control signal CS1 is overlapped with the high level duration of the fifth control signal CS5, e.g., the duration from the zero time t0 to the fourth time t4. In addition, the fifth light source block LB5 is turned on for a time period during which the high level duration of the second control signal CS2 is overlapped with the high level duration of the fifth control signal CS5, e.g., the duration from the zero time t0 to the fifth time t5. The sixth light source block LB6 is turned on for a time period during which the high level duration of the third control signal CS3 is overlapped with the high level duration of the fifth control signal CS5, e.g., the duration from the zero time t0 to the sixth time t6.

When the third dimming frame DF3 begins, the fourth control signal CS4 is maintained at the low state, the fifth control signal CS5 is changed into the low state, and the sixth control signal CS6 is changed into a high state. The high state of the sixth control signal CS6 is maintained during the whole duration of the second dimming frame DF3.

In the third dimming frame DF3, the high level duration of the first control signal CS1 is set from the zero time t0 to the seventh time t7, the high level duration of the second control signal CS2 is set from the zero time t0 to the eighth time t8, and the high level duration of the third control signal CS3 is set from the zero time t0 to the ninth time t9.

Accordingly, in the third dimming frame DF3, only the seventh to ninth light source blocks LB7 to LB9 among the first to ninth light source blocks LB1 to LB9 are turned on. In detail, the seventh light source block LB7 is turned on for a time period during which the high level duration of the first control signal CS1 is overlapped with the high level duration of the sixth control signal CS6, e.g., the duration from the zero time t0 to the seventh time t7. In addition, the eighth light source block LB8 is turned on for a time period during which the high level duration of the second control signal CS2 is overlapped with the high level duration of the sixth control signal CS6, e.g., the duration from the zero time t0 to the eighth time t8. The ninth light source block LB9 is turned on for a time period during which the high level duration of the third control signal CS3 is overlapped with the high level duration of the sixth control signal CS6, e.g., for the duration between the zero time t0 to the ninth time t9.

As described above, if the high level durations of the fourth to sixth control signals CS4 to CS6 are sequentially set in dimming frames, the first to ninth light source blocks LB1 to LB9 may be sequentially driven in the unit of three light source blocks during the first to third dimming frames DF1, DF2 and DF3.

When the above sequential driving scheme is employed, the time periods of the high level durations of the first to third control signals CS1 to CS3 are changed in each of the first to third dimming frame DF1, DF2 and DF3 to control the turn-on durations of light source blocks corresponding thereto. Accordingly, an amount of light output from the first to ninth light source block LB1 to LB9 may be effectively and substantially precisely controlled.

Figure 20:
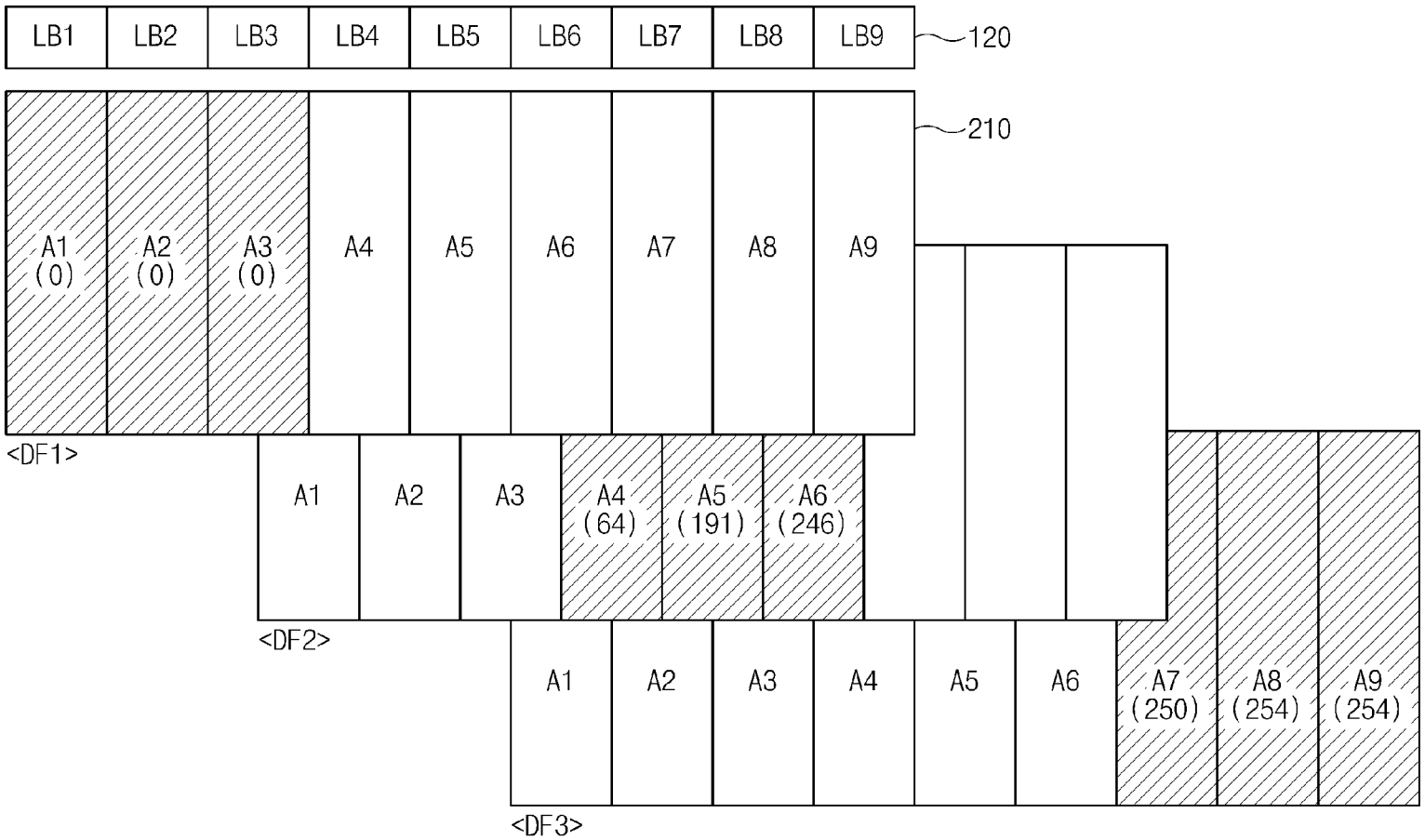
FIG. 20 is a block diagram showing a dimming region in first to third dimming frames of FIG. 19.

FIG. 20 is a block diagram showing a dimming region in the first to third dimming frames DF1, DF2 and DF3 of FIG. 19.

Referring to FIG. 20, the liquid crystal display panel 210 is divided into the first to ninth dimming regions A1 to A9 corresponding to the first to ninth light source blocks LB1 to LB9 of the light source unit 120. The number of dimming regions defined in the liquid crystal display panel 210 may vary depending on the number of light source blocks. In an alternative exemplary embodiment, when twelve light source blocks are provided in the light source unit 120, the liquid crystal display panel 210 may be divided into twelve dimming regions.

When the dimming signal PWM applied to the dimming circuit 112 is represented by 8 bits, and an image displayed in the first to ninth dimming regions A1 to A9 defined in the liquid crystal display panel 210 may be converted to representative brightness values of the image, the image may be expressed in 256 brightness levels (0-255). In an exemplary embodiment, among the first to ninth dimming regions A1 to A9, the first to third dimming regions A1 to A3 may have a representative brightness value of 0, the fourth dimming region A4 may have a representative brightness value of 64 and the fifth dimming region A5 may have a representative brightness value of 191. The sixth dimming region A6 may have a representative brightness value of 246, and the seventh dimming region A7 may have a representative brightness value of 250. The eighth and ninth dimming regions A8 and A9 may have a representative brightness level of 254.

In an exemplary embodiment, when time taken to display one image on the whole area of the liquid crystal display panel 210 is defined one image frame, the one image frame may include consecutive first to third dimming frames.

When the one image frame includes consecutive first to third dimming frames, the first to third blocks LB1 to LB3 operate in the first dimming frame DF1 to supply light to the first to third dimming regions A1 to A3, the fourth to sixth light source blocks LB4 to LB6 operate in the second dimming frame DF2 to supply light to the fourth to sixth dimming regions A4 to A6, and then the seventh to ninth light source blocks LB7 to LB9 operate in the third dimming frame DF3 to supply light to the seventh to ninth dimming regions A7 to A9. Accordingly, the first to ninth light source blocks LB1 to LB9 are sequentially driven in the unit of three light source blocks during the one image frame.

Figure 21:
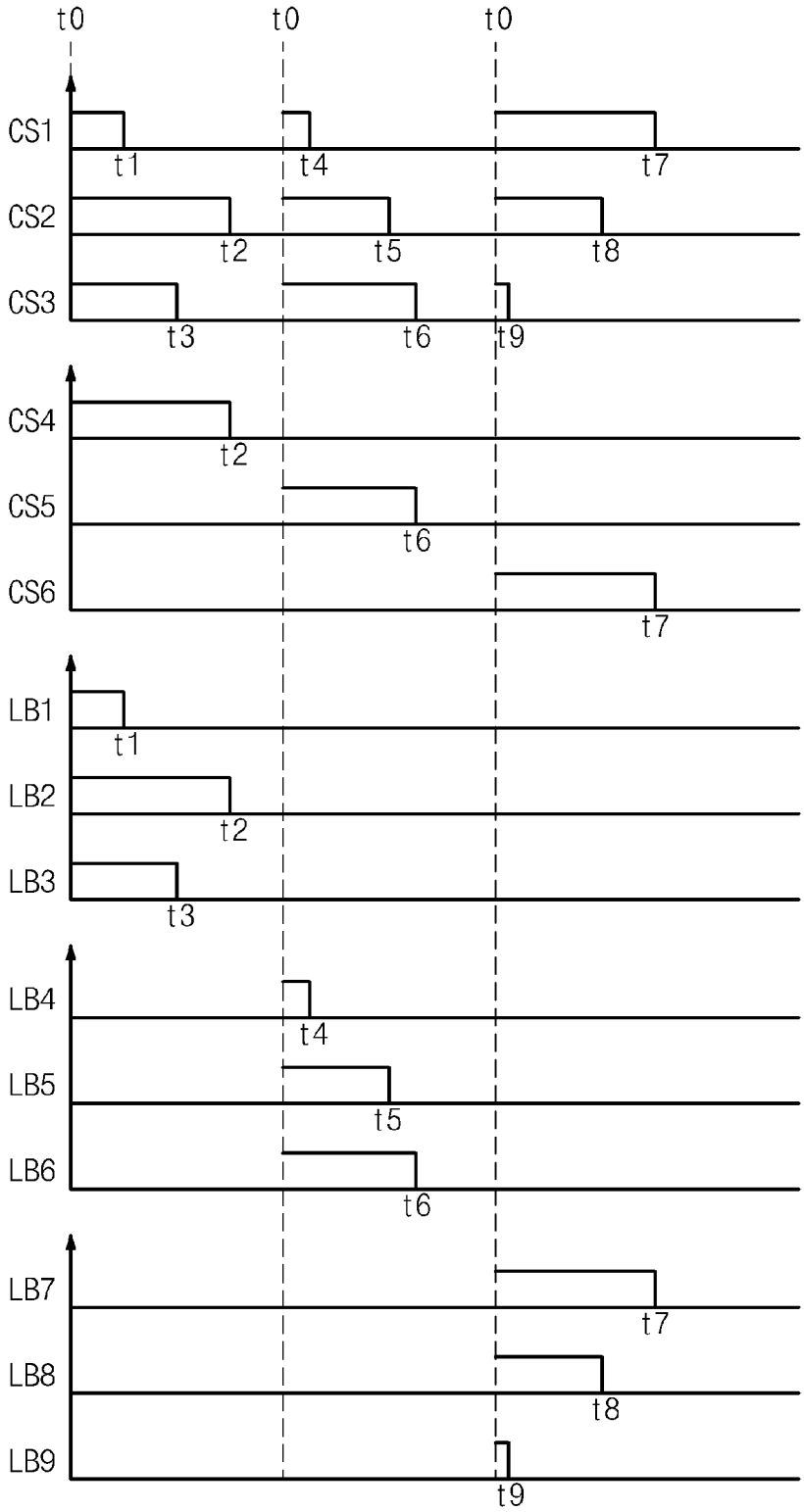
FIG. 21 is a signal timing diagram showing the turn-on durations of first to ninth light source blocks according to the high level durations of the first to sixth control signals in an alternative exemplary embodiment.

FIG. 21 is a signal timing diagram showing the turn-on durations of first to ninth light source blocks LB1 to LB9 according to the high level durations of the first to sixth control signals CS1 to CS 6. The signal timing diagram of FIG. 21 is substantially the same as the signal timing diagram in FIG. 19 except for the time periods of the high level durations of the fourth to sixth control signals.

Referring to FIG. 21, in the first dimming frame DF1, the high level duration of the fourth control signal CS4 has a time period the same as the longer time period among time periods of high level durations of the first to third control signals CS1 to CS3. Accordingly, the high level duration of the fourth control signal CS4 is set from the zero time t0 to the second time t2 in the first dimming frame DF1.

In the second dimming frame DF2, the high level duration of the fifth control signal CS5 may have a time period the same as the longer time period among time periods of high level durations of the first to third control signals CS1 to CS3. Accordingly, the high level duration of the fifth control signal CS5 is set from the zero time t0 to the sixth time t6 in the second dimming frame DF2.

In the third dimming frame DF3, the high level duration of the sixth control signal CS6 may have a time period the same as the longer time period among time periods of high level durations of the first to third control signals CS1 to CS3. Accordingly, the high level duration of the sixth control signal CS6 is set from the zero time t0 to the seventh time t7 in the third dimming frame DF3.

As described above, the time periods of the high level durations of the fourth to sixth control signals CS4 to CS6 are not maintained during the whole duration of each of the first to third dimming frames DF1 to DF3, and the power consumption of the backlight unit is thereby substantially reduced.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display apparatus comprising:

a backlight unit which emits a light; and a display panel which receives the light to display an image, wherein the backlight unit comprises:

a driving circuit which outputs a driving voltage and a reference voltage; and p light source blocks connected to the driving circuit, p being a natural number greater than or equal to 2, wherein each light source block of the p light source blocks receives the driving voltage through a first terminal thereof and the reference voltage through a second terminal thereof to generate the light, and the p light source blocks are divided into a plurality of groups, each group including at least two light source blocks, wherein the driving circuit comprises:

a first switching section which applies the driving voltage to first terminals of the p light source blocks; and a second switching section which applies the reference voltage to the second terminal of at least one of the p light source blocks, wherein the first switching section comprises n switching devices commonly connected to each other, n being a natural number greater than or equal to 1, and each of the n switching devices is connected to first terminals of the at least two light source blocks in a group corresponding thereto, wherein the second switch section comprises m switching devices commonly connected to each other, m being a natural number greater than or equal to 1, and each of the m switching devices is connected to at least one of second terminals of the at least two light source blocks of each group, wherein the driving circuit supplies n first control signals to the n switching devices, and supplies m second control signals to the m switching devices, and wherein a high level duration of a first control signal of the n first control signals and a high level duration of a second control signal of the m second control signal substantially overlap with each other in time, and a turn-on duration of a light source block which receives the first control signal and the second control signal is determined by a substantially overlapping time period of the high level duration of the first control signal and the high level duration of the second control signal at the start of each frame.

2. The display apparatus of claim 1, wherein each light source block of the p light source blocks emits light when a switching device of the n switching devices connected to the first terminal thereof and a switching device of the m switching devices connected to the second terminal thereof are turned on.

3. The display apparatus of claim 1, wherein a sum of n and m is less than p.

4. The display apparatus of claim 1, wherein n and m are divisors of p and make a smallest sum among all possible sums of two divisors of p, wherein a product of the two divisors is equal to p.

5. The display apparatus of claim 1, wherein the n first control signals are simultaneously applied to the n switching devices, and the m second control signals are sequentially applied to the m switching devices in one dimming frame unit.

6. The display apparatus of claim 1, further comprising a printed circuit board with the light source blocks disposed thereon, wherein the printed circuit board comprises:

q connection lines through which the driving voltage is supplied to the first terminal of each light source block, q being a natural number greater than or equal to 1; and r connection lines through which the reference voltage is supplied to the second terminal of at least one of the light source blocks, r being a natural number greater than or equal to 1, wherein a sum of q and r is less than p.

7. The display apparatus of claim 6, wherein q and the r are two divisors of p and define a smallest sum among all possible sums of two divisors of p, wherein a product of the two divisors is equal to p.

8. The display apparatus of claim 6, wherein the printed circuit board comprises a double-sided printed circuit board, and each connection line of the q connection lines and the r connection lines is disposed on at least one surface of the double-sided printed circuit board.

9. The display apparatus of claim 6, further comprising a connector which connects the q connection lines of the printed circuit board to the first switching section and connects the r connection lines of the printed circuit board to the second switching section.

10. The display apparatus of claim 6, further comprising a light guide plate which receives the light output from the backlight unit through at least one side surface thereof and outputs the light through an exit surface thereof.

11. The display apparatus of claim 10, further comprising a plurality of light emitting diodes disposed on a top surface of the printed circuit board, wherein an incident surface of each of the plurality of light emitting diodes is substantially perpendicular to the top surface of the printed circuit board.

12. The display apparatus of claim 10, further comprising a plurality of light emitting diodes disposed on a top surface of the printed circuit board, wherein an incident surface of each of the plurality of light emitting diodes is substantially parallel to a top surface of the printed circuit board.

13. The display apparatus of claim 1, wherein the display panel is divided into a plurality of dimming regions corresponding to the p light source blocks, and brightness of each of the p light source blocks is adjusted based on a representative brightness value of a respective dimming region of the plurality of dimming regions corresponding to each of the p light source blocks.

14. The display apparatus of claim 13, further comprising a timing controller which supplies an image signal to the display panel, wherein the timing controller comprises:

a timing determiner which calculates and determines a representative brightness value of each dimming region of the plurality of dimming regions based on the image signal;

a representative value compensator which calculates a brightness compensation value of each dimming region of the plurality of dimming regions by compensating the representative brightness value; and a pixel corrector which corrects the image signal supplied to each dimming region of the plurality of dimming regions based on the brightness compensation value.

15. The display apparatus of claim 14, wherein the pixel corrector compares a target dimming level of each light source block and a real dimming level of the light source block, and corrects the image signal supplied to each dimming region based on a differential value between the real dimming level and the target dimming level when the real dimming level is different from the target dimming level.

16. A display apparatus comprising:

a backlight unit which emits a light; and a display panel having a light guide plate which receives the light on a lateral surface of the light guide plate to display an image, wherein the backlight unit comprises:

a driving circuit which outputs a driving voltage and a reference voltage;

p light source blocks connected to the driving circuit, p being a natural number greater than or equal to 2, wherein each light source block of the p light source blocks receives the driving voltage through a first terminal thereof and the reference voltage through a second terminal thereof to generate the light, and the p light source blocks are divided into a plurality of groups, each group including at least two light source blocks, wherein the driving circuit comprises:

a first switching section which applies the driving voltage to first terminals of the p light source blocks; and a second switching section which applies the reference voltage to the second terminal of at least one of the p light source blocks, wherein the backlight unit further comprises a printed circuit board with the light source blocks disposed thereon, and a plurality of light emitting diodes disposed on a top surface of the printed circuit board, wherein a light emission surface of each of the plurality of light emitting diodes is substantially perpendicular to the top surface of the printed circuit board and substantially parallel to and facing the lateral surface of the light guide plate.

* * * * *